US012203259B1

(12) United States Patent
Sacks et al.

(10) Patent No.: US 12,203,259 B1
(45) Date of Patent: Jan. 21, 2025

(54) UNIVERSAL CHANNEL DRAIN FITTING

(71) Applicant: Tempo Products, Inc., Fresno, CA (US)

(72) Inventors: Rael Sacks, Fresno, CA (US); David G. Sacks, Fresno, CA (US); Jonathan M. Sacks, Fresno, CA (US)

(73) Assignee: Tempo Products, Inc., Fresno, CA (US)

( * ) Notice: Subject to any disclaimer, the term of this patent is extended or adjusted under 35 U.S.C. 154(b) by 119 days.

(21) Appl. No.: 18/125,090

(22) Filed: Mar. 22, 2023

(51) Int. Cl.
*E03F 5/04* (2006.01)

(52) U.S. Cl.
CPC ..... *E03F 5/0407* (2013.01); *E03F 5/041* (2013.01)

(58) Field of Classification Search
CPC ..... E03F 5/0407; E03F 5/0408; E03F 5/041; E03F 5/046
USPC ..... 4/507, 510, 679; 405/42, 119–123
See application file for complete search history.

(56) References Cited

U.S. PATENT DOCUMENTS 4,321,713 A * 3/1982 Thompson ..... E03F 5/0407 4/290
6,027,283 A * 2/2000 Schweinberg ..... E03F 3/046 405/118
2012/0110827 A1* 5/2012 Doolittle ..... E03F 5/0408 29/527.1

OTHER PUBLICATIONS

NDS Product Catalog, catalog, 2021, p. Nos. 1 and 61, NDA, U.S.
TEMPO Spec Sheet: Square Catch Basins, Tempo Products, Inc., U.S.
NDS Technical Specifications, Next Generation Catch Basin, National Diversified Sales, Inc., U.S.
Stormdrain Plus Surface Water Drainage Solution, Stormdrain Plus Page, Internet, downloaed Mar. 12, 2023, U.S.

* cited by examiner

*Primary Examiner* — Tuan N Nguyen
(74) *Attorney, Agent, or Firm* — Richard A. Ryan

(57) ABSTRACT

A universal channel drain fitting that allows an installer to easily and quickly modify the fitting to provide a plurality of fitting functions. The universal fitting has a base with base panel and a leg assembly. The base panel has a panel opening and the leg assembly has a plurality of upwardly extending legs. The base removably supports a top cap, a bottom cap, two end caps and two side caps that each have a plate section and a component section. The legs define a plurality of leg pairs that support the end caps and side caps, the plate section of which are slidably received in slots associated with each leg member. A top cap is secured to the leg assembly and a bottom cap is secured to the panel opening. The component sections block fluid flow or allow fluid to pass in a desired direction through the universal fitting.

20 Claims, 16 Drawing Sheets

UNIVERSAL CHANNEL DRAIN FITTING

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The present invention relates generally to drainage systems that are configured to capture excess water or other liquid in one location and transfer the liquid to another location where the liquid will not cause damage. In particular, the present invention relates to channel drain systems and apparatuses utilized in such systems to connect one component of a channel drain to another component in a manner which facilitates flow of excess liquid from one location to another. Even more particularly, the present invention relates to fittings and other connectors that are utilized to effectively connect a section of a channel drain to another section of channel drain or to another drainage system component.

B. Background

Drainage systems are utilized to transfer excess water or other liquids from a location where the liquid is considered excess to a location where the liquid can be utilized or be directed to an area where the liquid can be safely handled. In one configuration, a local area drainage system is commonly utilized to capture excess liquid in a location where the liquid could cause damage and to move the liquid to another location where it will not cause damage, such as directing water away from around a house, business or other structure to a stormwater drainage system that will move the water to a stormwater collection basin or other designated area or body of water. Excess water can be a result of a rain storm, melting snow, over-watering by sprinklers or irrigation, vehicle washing and the like. Other excess liquids can be a result of spills, drains from structures and other unplanned releases of liquids. For purposes of the present disclosure, reference herein will primarily be made to drainage systems that are used to collect and move water. However, as will be readily appreciated by persons who are skilled in the relevant art, such drainage systems can equally be utilized to collect and move a wide variety of other liquids.

One type of drainage system that is commonly utilized to collect and move excess water is referred to as a channel drain system. As well known in the relevant art, channel drain systems are utilized to protect property during storms or other sources of excess water by capturing the water and transporting it to areas where the excess water cannot cause damage. A typical channel drain system comprises a series of elongated channel drain sections that define a generally U-shaped channel having a slotted cover, often referred to as a grate, that allows water to flow into the U-shaped channel. Typically, channel drain systems are configured for the grate to be removed so that the channel can be periodically cleaned out. In a common or standard installation, both the channel and the grate are placed in a trench that is sized and configured for the grate to be positioned at grade level. The trench is then normally backfilled with concrete or soil to hold the channel in place. The surface area around the grate is configured to slope towards the grate so excess water will flow into the channel through the slots in the grate. The channel itself is installed at a slope so that the water collected therein will flow by gravity from the area to be protected to an area where the excess water can be discharged, such as towards a street drain or a man-made French drain at a suitable location.

As well known to persons who are generally familiar with drainage systems, most channel drain systems cannot run in a straight line because the channel drains need to follow the layout of the area the system is draining. The non-linear nature of such drainage systems require fittings that connect to channel drains in a manner which allows the system to change directions. Such fittings may include tees, elbows, crosses and the like. Additionally, the water collected by the system must exit the channel drain either at its end or be discharged through selected drainage exit points along the bottom of the channel drain system. If the water exits the system from the bottom, a sealing plug is needed to close off the end of the channel to direct the water downward. Because each section of channel drain is typically configured in a relatively short length, a series of channel couplers and fittings are required to interconnect each section of channel drain.

All currently available channel drain systems typically require the use of a large number of different couplers and fittings in order to complete the system. As a result, during installation of a channel drain system, the installer will need to have a sufficient number of individual channel drain sections, with the appropriate grates, and numerous channel couplers and other fittings to connect the channel drain sections together and to other drainage components, such as pipes and drains. For example, for a typical channel drain system, an installer will need to use a plurality of tees, crosses, elbows, couplings, end plugs, end outlet adapters, bottom outlet discharge adapters and the like to complete the channel drainage system. In order to efficiently connect sections of channel drains and the other components utilized in a channel drain system, the installer has to have all of the possible couplers and fittings with him or her to avoid having to return to the shop or go to a store to obtain any "missing" couplers and/or fittings that are necessary to finish installing the system.

As will be readily appreciated by persons who are skilled in the relevant art, it would be beneficial for installers of channel drain systems to have a single fitting that functions and provides the benefits of the wide variety of different couplers and fittings which are necessary to install a complete channel drain system. Unfortunately, prior attempts at providing such a single fitting have certain issues or limitations that generally make such attempts at a single component not that popular amongst persons who would otherwise benefit from their use. For instance, some of the prior art coupler/fitting components are hard to fabricate, which generally make these components more expensive than desired or likely to come apart in a manner that is not desired or intended. Other attempts require the installer to have to utilize tools, adhesives or other materials to be properly placed in a channel drain system. One prior art product has a four-outlet fitting that attaches to the end of a channel drain, but it requires tools (for example a knife must be used to open an outlet if required) to assemble and does not have an ability to drain water or other liquids from the bottom. As such, most installers of channel drain systems utilize the standard prior art fitting and, as a result, have to carry and have readily available a sufficient number and variety of couplers and other fittings in order to have available what he or she needs to install a channel drain system.

What is needed, therefore, is a universal channel drain fitting that can be used in place of a number of separate, individual couplers and fittings to install a channel drain system. More specifically, what is needed is a universal channel drain fitting that allows the user to easily adapt a single universal fitting for use as tees, crosses, elbows, couplings, end plugs, end outlet adapters, bottom outlet discharge adapters and the like in a channel drain system. Even more specifically, a single universal channel drain fitting should be configured in a manner to allow the installer to use the universal fitting in place of a wide variety of standard fittings so he or she can more effectively and efficiently install a channel drainage system. It would be particularly beneficial for a universal channel drain fitting to be able to be selectively configured by an installer as one of a number of standard couplers and fittings without the need for tools, adhesives or other materials so he or she can easily and quickly make modifications at a system location while installing a channel drain system. Preferably, any universal channel drain fitting should be manufactured of and in a manner that provides a relatively low cost universal fitting so that the fitting can be utilized in a wide variety of channel drain systems.

SUMMARY OF THE INVENTION

The following presents a simplified summary of the disclosure of the present invention in order to provide a basic understanding of the invention to the reader. As such, this Summary is not an extensive overview of the disclosure and it does not identify key/critical elements of the invention or delineate the scope of the invention. The sole purpose of this Summary is to present some concepts disclosed herein in a simplified form as a prelude to the more detailed description that is presented later.

The use of terms such as "including", "comprising", "having" or "with" and variations thereof herein is meant to encompass the items listed thereafter and equivalents thereof. The terms "a" and "an" herein do not denote a limitation of quantity, but rather denote the presence of at least one of the referenced items. Further, the use of terms "first", "second", and "third", and the like, herein do not denote any order, quantity, or importance, but rather are used to distinguish one element or feature of an element from another. The term "and/or," when used herein with a list of two or more items, means that any one of the listed items can be employed by itself, or any combination of two or more of the listed items can be employed.

The new universal channel drain fitting of the present invention provides the benefits and solves the problems identified above. That is to say, the present invention is directed to a new and improved universal channel drain fitting which is structured and arranged to be utilized in place of having a wide variety of separate, individual couplers and fittings (hereinafter, collectively referred to as "fittings") to install a channel drain system. Specifically, the new universal channel drain fitting of the present invention allows an installer of a channel drain system to easily adapt the new universal fitting so that it can be utilized as a tee, cross, elbow, coupling, end plug, end outlet adapter, bottom outlet discharge adapter and like fittings (collectively referred to as "standard fittings") in a channel drain system. More specifically, the new universal channel drain fitting is structured and arranged in a manner which allows the installer to use the new universal fitting in place of a wide variety of standard fittings. Utilizing the universal channel drain fitting of the present invention instead of standard fittings, the installer can more effectively and efficiently connect various drain components together when he or she is installing a channel drainage system. The installer can configure the new universal channel drain fitting as one of a wide variety of standard fittings without the need for tools, adhesives or other materials, which allows him or her to easily and quickly make the necessary modifications to the universal channel drain fitting while he or she is in the field installing a channel drain system. As such, the new universal channel drain fitting will eliminate or at least substantially reduce the need for the installer to acquire and carry with him or her a sufficient number and wide variety of different standard fittings when going to a location to install a channel drain system. In the preferred embodiments of the present invention, the new universal channel drain fitting is manufactured of and in such a manner that results in a relatively low cost universal fitting that can be utilized in a wide variety of channel drain systems. The universal channel drain fitting of the present invention is a single universal fitting that can be configured to achieve the function and benefits of a wide variety of standard fittings. The new universal channel drain fitting can be assembled very simply and quickly and without the use of any tools, adhesives or other materials. With the new universal channel drain fitting, the installer only has to have the universal channel drain fitting, which may be provided in a kit, available to him or her instead of having to have a multitude number of a wide variety of standard fittings to be able to install a channel drain system. In a preferred embodiment of using the new universal channel drain fitting, the kit components of the universal fitting can be packed in a relatively small box that contains all of the components that are necessary to make any of the standard fittings that may be required to install a channel drain system. Some of the standard fittings that can be assembled from a kit comprising the new universal channel drain fitting include: (1) a coupler to connect two pieces of channel sections together; (2) an end plug to seal off the end of the channel formed by multiple channel sections; (3) a tee to join an additional perpendicular channel section to a linear length of the channel; (4) an elbow to change direction, such as a ninety degree elbow to turn a corner ninety degrees; (5) a four-way cross to connect two perpendicular channel sections together; (6) a bottom drain outlet, with or without a leaf catcher, to connect to a discharge pipe from the bottom of the channel; and (7) an end outlet to connect to a discharge pipe at the end of the channel to direct water or other fluids away from the area where it has been collected. As will be readily appreciated by persons who are skilled in the relevant art, the new universal channel drain fitting can be configured for any size or shape channel in a channel drain system.

In one embodiment of the present invention, the universal channel drain fitting generally comprises a base and a plurality of caps that are selected by an installer of a channel drain system to connect to a channel drain or other drain system part to achieve certain downstream flow control purposes for the fitting, such as connecting to a downstream channel drain or system part to controllably direct water or other liquids or to stop the flow of such liquids. The base comprises a base panel and a leg assembly, with the base panel having an upper surface and a lower surface and the leg assembly being attached to or integral with the base panel so as to extend upwardly from the upper surface of the base panel. The leg assembly has a plurality of upwardly extending leg members that are structured and arranged for each of the plurality of leg members to have at least two adjacent leg members so as to form a plurality of leg member pairs. The new universal channel drain fitting has one or more end caps, one or more side caps, a bottom cap and a top cap that each have a plate section and a component section. The plate section of each of the end caps are cooperatively structured and arranged with the leg assembly so as to be upwardly supported by one of the plurality of leg member pairs. The plate section of each of the side caps are also cooperatively structured and arranged with the leg assembly so as to be upwardly supported by one of the plurality of leg member pairs. The bottom cap is structured and arranged to be positioned against one of the upper surface and the lower surface of the base panel. The top cap is structured and arranged to be positioned in spaced apart relation above the base panel and engage at least one of the leg assembly, the one or more end caps and the one or more side caps. The base, the end caps, the side caps, the bottom cap and the top cap define an interior area of the universal channel drain fitting that will receive water or another liquid into the interior area thereof from a flow path through a channel drain so as to control the continued flow of the liquid to another channel drain and/or system part.

In one embodiment, each of the leg members have a slot associated therewith and each of the plate sections of the end caps and the side caps are cooperatively sized and arranged for the plate sections to slidably engage the slots of the leg members so as to upwardly support the end caps and the side caps on the base. The top member has a downwardly extending base mounting assembly attached to or integral with the plate section of the top member, with the base mounting assembly having a plurality of side members and lip members defining a plate edge area therebetween, the plate edge area sized and configured to receivably engage a top edge of each of the plate sections therein to hold each of the one or more end caps and the one or more side caps in place on the base. In a preferred embodiment, the base mounting assembly has a corner member that interconnects each of the side members and a top post area defined between each of the corner members and the plate lip. Each of the top post areas are sized and configured to engagedly receive a top post of the leg assembly so as to secure the top cap to the base.

In a preferred embodiment, the leg assembly further comprises a leg base interconnecting each of the leg members, with the leg base having an upwardly extending slot member at each of the leg members so that each of the leg members has a slot associated therewith that is sized and configured to slidably receive a portion of the plate sections of the end caps and the side caps. Preferably, the leg base has a slot therein that is sized and configured to receive a bottom edge of the plate sections of each of the end caps and each of the side caps. In this configuration, the slot member defines the slot associated with each of the leg members, with each of the slots of the leg members being sized and configured to slidably receive one of a first edge and a second edge of each of the plate sections of the end caps and the side caps. To better support the end caps and side caps, the slots associated with the leg members are connected to the slot of the leg base between each leg member pair to define a slot group that receives a plate section of one of the end caps or one of the side caps therein.

For a typical universal channel drain fitting, the one or more end caps comprise a first end cap and a second end cap, the one or more side caps comprises a first side cap and a second side cap, the leg assembly comprises a first leg member, a second leg member, a third leg member and a fourth leg member. The first leg member and the second leg member define a first leg member pair for supporting the first end cap, the second leg member and the third leg define a second leg member pair for supporting the second side cap, the third leg member and the fourth leg member define a third leg member pair for supporting the second end cap and the fourth leg member and the first leg member define a fourth leg member pair for supporting the first side cap.

In a preferred embodiment, the base panel of the new universal channel drain fitting has a panel opening that is disposed, generally centrally, through the base panel and the bottom cap has an opening engaging mechanism which is structured and arranged to engage the panel opening of the base panel to secure the bottom cap to the base of the universal channel drain fitting. Although the bottom cap can be secured to the panel opening from below the base panel or from above the base panel (e.g., from the interior area), in a preferred configuration the bottom cap is received from below to abut the lower surface of the base panel. In one embodiment, the opening engaging mechanism comprises a plurality of clip members that are each structured and arranged to be received in the panel opening to engage the panel opening and hold the bottom cap in place.

In a typical "standard" configuration, the component section of the first end cap is a coupler that can connect to an upstream positioned channel drain and the component section of the top cap is a grate to receive water or other liquid into the channel drain system through the new universal channel drain fitting. The component section of the end caps and the side caps can, as an example be a coupler, a solid plate, an adapter and the like. Although the component section of the top plate is typically a grate, the component section can also be a solid plate, an adapter or the like. Typically, the component section of the bottom cap is either a coupler, solid plate or bottom drain.

The detailed description set forth below provides a more detailed and specific description that will make reference to the accompanying drawings. The drawings and specific descriptions of the drawings included herewith, as well as any specific or alternative embodiments discussed, are intended to be read in conjunction with the entirety of this disclosure. As will be readily appreciated by persons who are skilled in the art, the new universal channel drain fitting may be embodied in many different forms and should not be construed as being limited to the embodiments which are set forth herein. Instead, the preferred embodiments set forth below are provided by way of illustration only and so that this disclosure will be thorough, complete and fully convey understanding to those persons who are skilled in the relevant art.

Accordingly, the primary object of the present invention is to provide a new universal channel drain fitting having the various advantages set forth above and elsewhere in the present disclosure and which overcomes the disadvantages and limitations which are associated with presently available apparatuses and systems for connecting together components of a channel drain system.

It is an important object of the present invention to provide a new and improved universal channel drain fitting that is structured and arranged to be used in place of and instead of a number and wide variety of standard fittings when an installer is installing a channel drain system.

It is also an important object of the present invention to provide a new and improved universal channel drain fitting that can be easily adapted into one of a wide variety of different standard fittings for a channel drain system without the need for tools, adhesives or other materials.

An important aspect of the present invention is that it provides a new universal channel drain fitting which accomplishes the objectives set forth above and elsewhere in the present disclosure.

Another important aspect of the present invention is that it provides a new universal channel drain fitting which allows an installer of a channel drain system to easily, without tools, adhesives or the like, adapt the new universal channel drain fitting so that the same base fitting can be utilized as many different types of standard fittings, such as a tee, cross, elbow, coupling, end plug, end outlet adapter, bottom outlet discharge adapter and the like in a channel drain system.

Another important aspect of the present invention is that it provides a new universal channel drain fitting which is structured and arranged to allow a channel drain installer to use the universal channel drain fitting in place of a wide variety of different standard fittings to more effectively and efficiently connect drain components together when he or she is installing a channel drainage system.

Another important aspect of the present invention is that it provides a new universal channel drain fitting which generally comprises a base made up of a base panel with an opening centrally disposed on the panel and a leg assembly that is attached to or integral with the base panel so as to extend four leg members outwardly therefrom, a top grate, and a plurality of side, end and bottom caps that are slidably received in slots in the leg members, with each of the caps configured to function as one of a wide variety of different types of standard fittings.

Another important aspect of the present invention is that it provides a universal channel drain fitting which eliminates or at least substantially reduces the need for an installer of a channel drain system to have with him or her a generally large number and wide variety of different standard fittings when going to a location to install the channel drain system.

Yet another important aspect of the present invention is that it provides a new universal channel drain fitting which is manufactured of materials and in a manner that results in a relatively low cost universal channel drain fitting which can be utilized in a wide variety of channel drain systems.

As will be explained in greater detail by reference to the attached figures and the description of the preferred embodiments which follow, the above and other objects and aspects are accomplished or provided by the present invention. As set forth herein and will be readily appreciated by persons who are skilled in the art, the present invention resides in the novel features of form, construction, mode of operation and combination of processes presently described and understood by the claims. The detailed description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
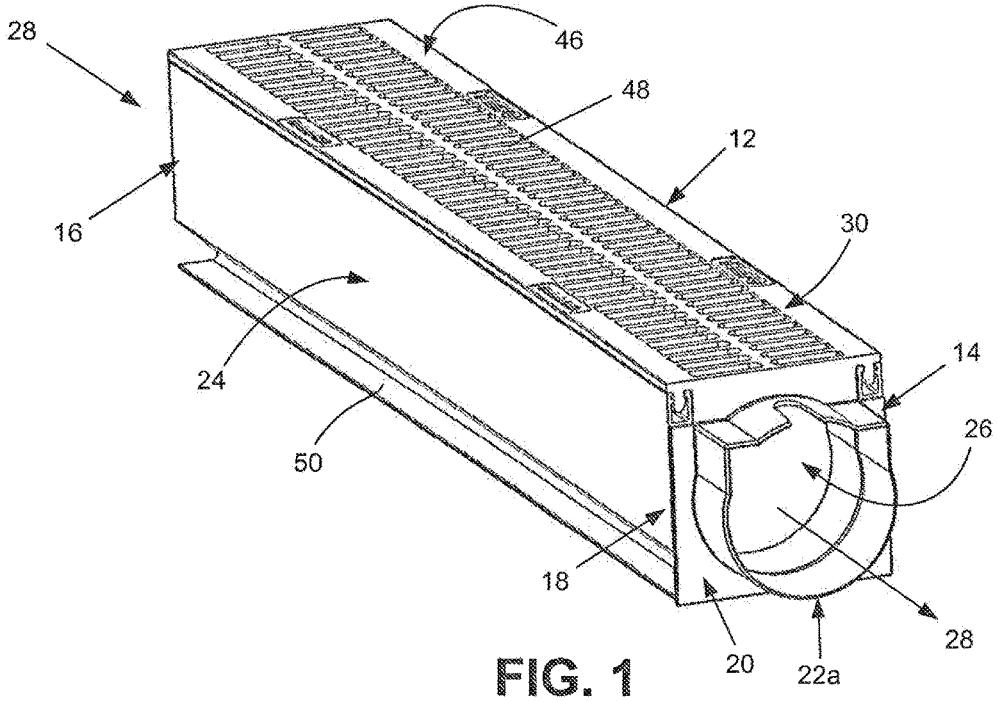
FIG. 1 (PRIOR ART)
FIG. 1 is a forward end perspective view of a prior art channel drain assembly comprising a prior art channel drain and a prior art coupler fitting at the forward end thereof.

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the universal channel drain fitting of the present invention, as well as examples of a channel drain with which the new fitting may be utilized, persons who are skilled in the relevant art will readily appreciate that the present invention is not so limited. In addition, the exemplary embodiments of the present invention are shown and described herein with only those components that are required to disclose the present invention. As such, it may be possible that some of the necessary elements for attaching and/or using the present invention are not shown or necessarily described below, but which are well known to persons who are skilled in the relevant art. As will be readily appreciated by such persons, the various elements of the present invention that are described below may take on any form which is consistent with forms that may be understood by a person of ordinary skill in the art having knowledge of standard channel drain fittings and the channel drains with which they may be utilized in a channel drain system.

A universal channel drain fitting that is configured pursuant to one or more of the preferred embodiments of the present invention is referred to generally as 10 in FIGS. 11-18, 41-42 and 45-47. As set forth in more detail below, the new universal channel drain fitting 10 (hereinafter, the "universal fitting") is structured and arranged to be utilized in a prior art channel drain system 11 having one or more channel drains 12 that are interconnected together and/or connected to other channel drain system parts 13, including drains, pipes and the like, with prior art fittings, as shown in FIGS. 1-10 and summarized in the system chart of FIG. 49. The general configuration and use of prior art fittings 14 that are utilized to connect sections of channel drains 12 together and/or to connect a channel drain 12 to a system part 13 are well known to persons who are skilled in the relevant art. The prior art fittings 14 are structured and arranged to be securely attached to an end, either the first or rearward end 16 or the second or forward end 18, of a prior art channel 12, as shown with regard to FIGS. 1, 7 and 9 (where the prior art fittings 14 are shown secured to the second/forward end 18 of a prior art channel drain 12). For purposes of describing the various functions and use of the universal fitting 10 of the present invention, the prior art fittings 14 comprise a plate section 20 and one or more functional component sections 22, as best shown in FIGS. 1 and 5-10. The plate section 20 helps properly position a prior art fitting 14 (e.g., prevent linear movement of the prior art fitting 14) at an end 16/18 of the channel drain 12 and support the component sections 22 that provide the functional aspect of the prior art fitting 14, such as interconnecting with and directing the flow of water and/or other fluids 23 into one or more adjacent channel drains 12, under ground drainage, a street or other drainage area, a piping system or the like, or blocking/stopping the flow of the liquid 23 through a channel drain 12 or the like.

Figure 2:
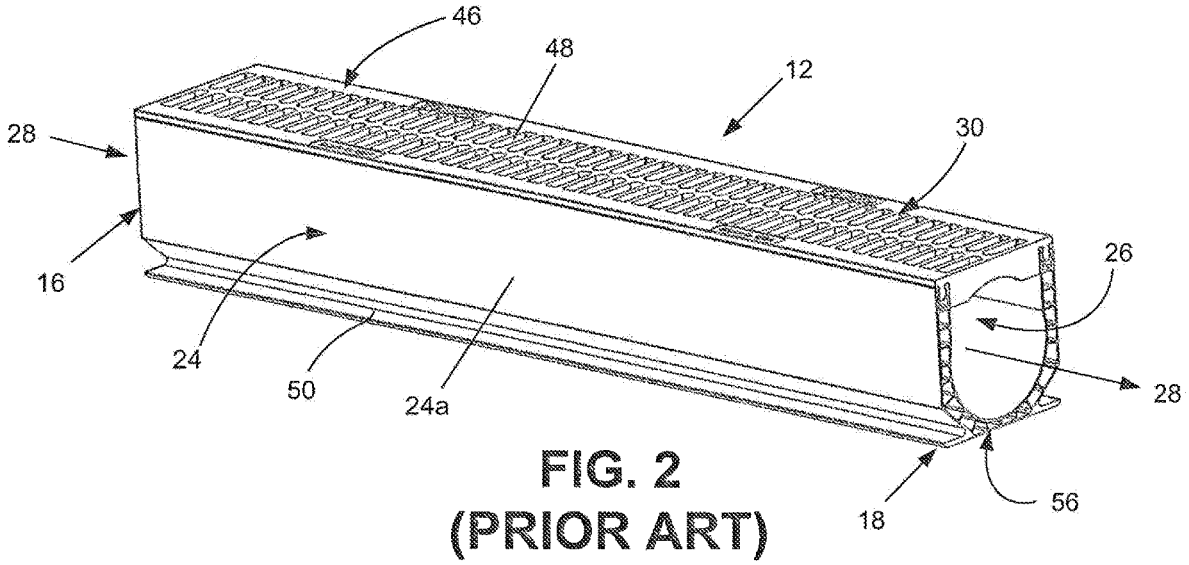
FIG. 2 (PRIOR ART)
FIG. 2 is a side perspective view of the prior art channel drain of FIG. 1 shown without the prior art coupler fitting.
Figure 3:
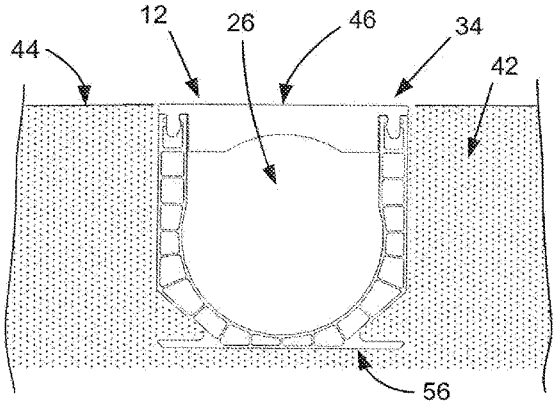
FIG. 3 (PRIOR ART)
FIG. 3 is an end view of the forward end of the prior art channel drain of FIG. 2.
Figure 4:
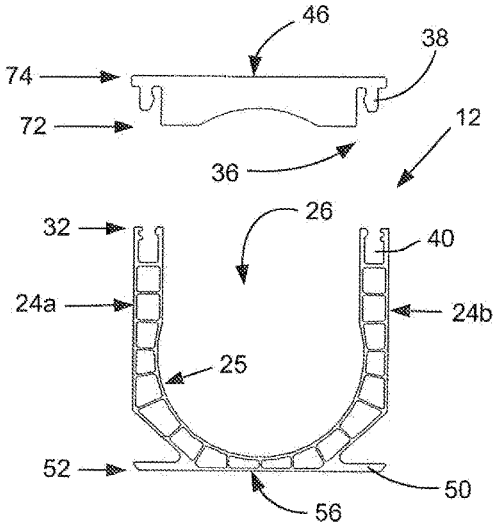
FIG. 4 (PRIOR ART)
FIG. 4 is an exploded forward end view of the prior art channel drain of FIG. 3.
Figure 5:
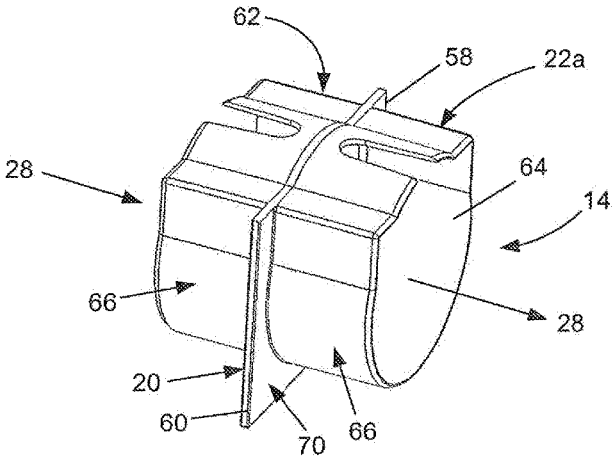
FIG. 5 (PRIOR ART)
FIG. 5 is a forward end perspective view of the prior art coupler fitting of FIG. 1 showing both the rearward and forward ends thereof.
Figure 6:
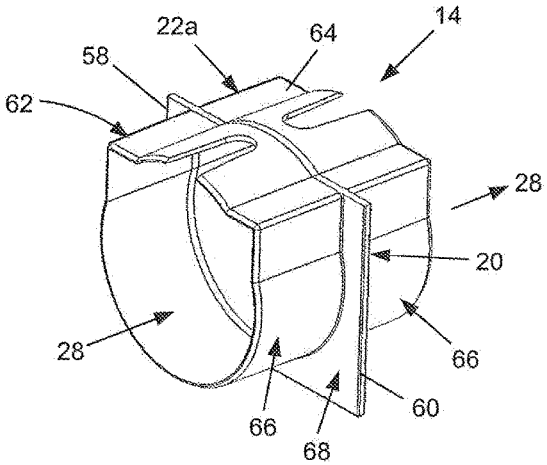
FIG. 6 (PRIOR ART)
FIG. 6 is a rearward end perspective view of the prior art coupler fitting of FIG. 5.
Figure 7:
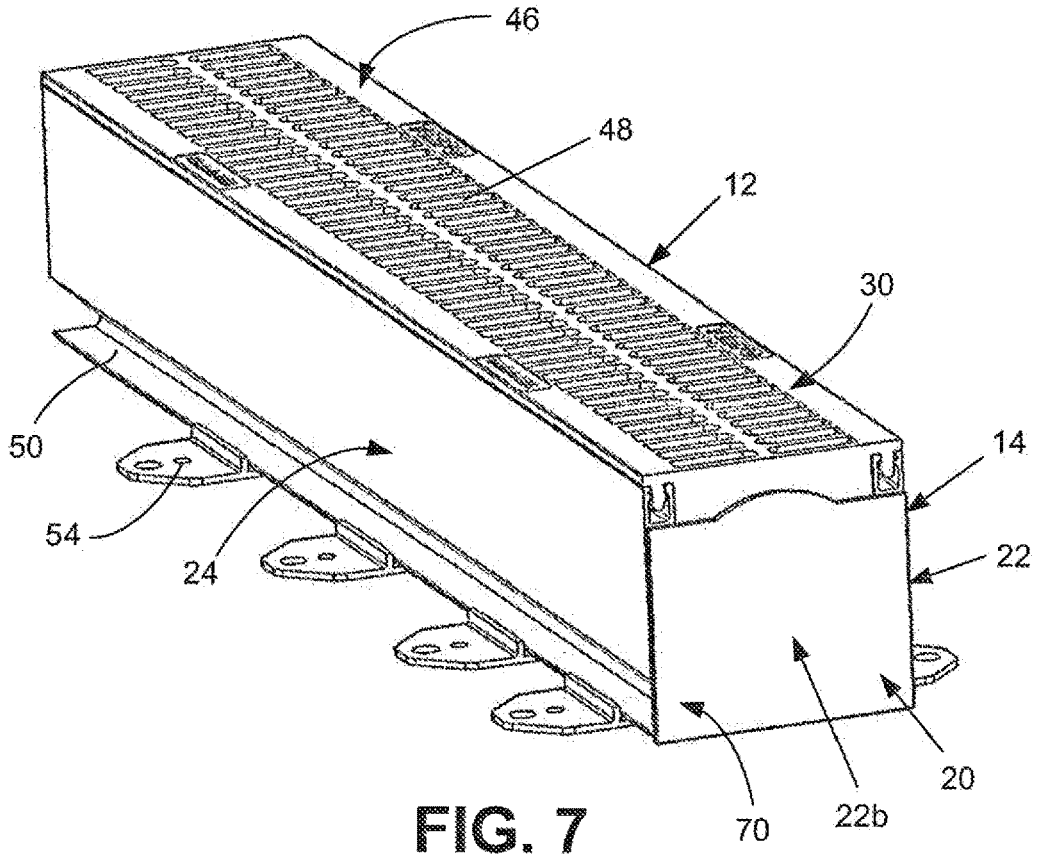
FIG. 7 (PRIOR ART)
FIG. 7 is a forward end perspective view of a prior art channel drain assembly comprising a prior art channel drain and a prior art end wall fitting at the forward end thereof.
Figure 9:
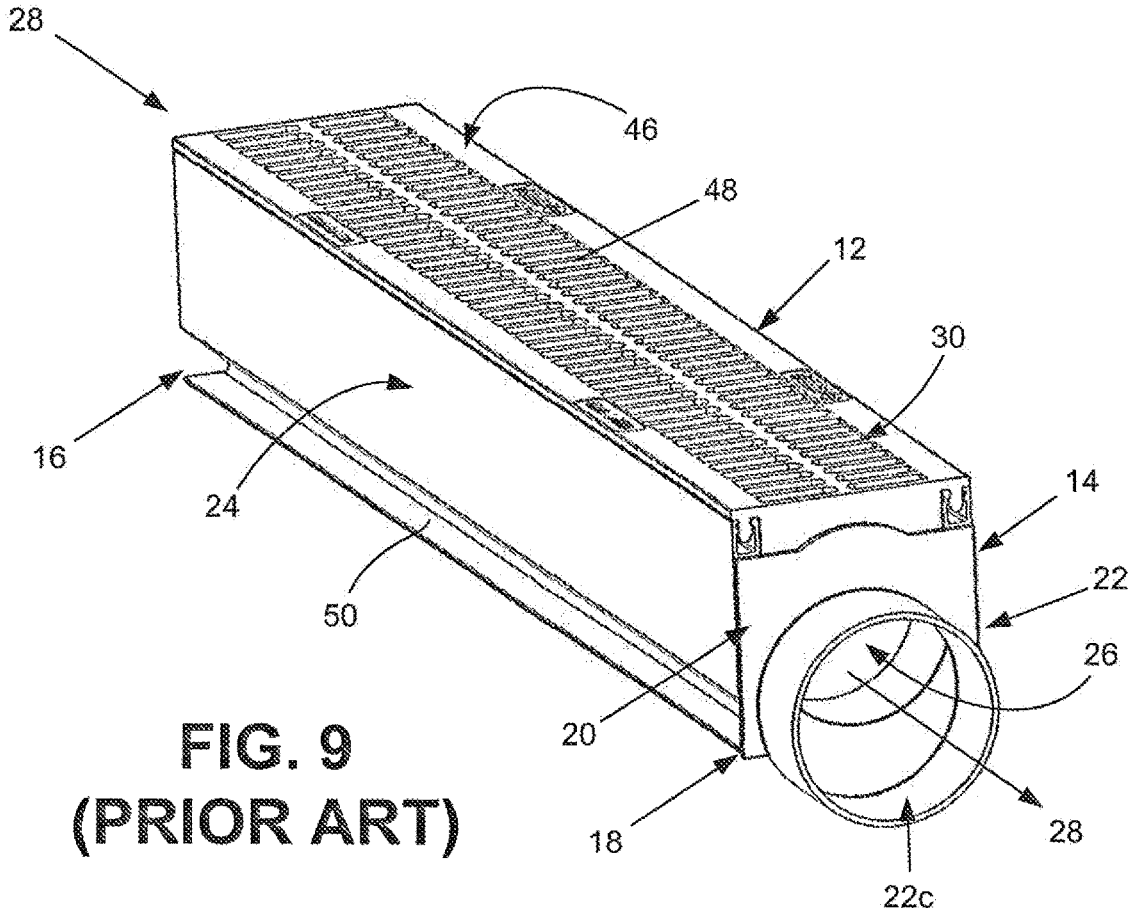
FIG. 9 (PRIOR ART)
FIG. 9 is a forward end perspective view of a prior art channel drain assembly comprising a prior art channel drain and a prior art adapter fitting at the forward end thereof.

As best shown in FIGS. 2-4, a single section of prior art channel drain 12 has one or more channel walls 24, whether sidewalls and bottom walls (typically these are a single contiguous wall), having inner surfaces 25 defining a generally U-shaped channel 26 through which water will flow along a flow path 28 from the first/rearward end 16 to the second/forward end 18, and a grate 30 that is secured to the upper ends 32 of the walls 24, as best shown in FIGS. 1-4, 7 and 9. The type of prior art channel drain 12 shown in the figures have the upper ends 32 of the walls 24 cooperatively structured and arranged with the grate 30 such that the grate 30 is pressed into and interlocks with the upper ends 32 of the walls 24 to snap the grate 30 in place on the prior art channel drain 12, as best shown with regards to FIGS. 1-3, 7 and 9 that show the grate 30 in its locked position 34 and FIG. 4 that shows the grate 30 in its unlocked position 36. More specifically, the grate 30 shown in the figures has a pair of downwardly projecting pins 38 that are cooperatively sized and configured with pin receivers 40 at the upper ends 32 of the walls 24 such that the pins 38 will be engagedly received inside the pin receivers 40 to effectively lock the grate 30 onto channel drain 12 at the upper ends 32 of the walls 24 thereof in the locked position 34 of grate 30. As set forth below, the positioning of the grate 30 onto the walls 24 of a prior art channel drain 12 also locks the prior art fitting 14 in place at an end 16/18 of the channel drain 12, as shown in FIGS. 1, 7 and 9.

When used with a channel drain system 11 the channel drain 12 having the grate 30 secured thereto is placed in the desired mounting media 42, which may be the ground, driveway, sidewalk or other surface, with the top surface 44 of media 42 (e.g., ground level) being in or near alignment with the upper surface 46 of the grate 30, as shown in FIG. 3. The grate 30 has a plurality of openings 48 in the upper surface 46 of the grate 30 which allow water and/or other liquids 23 from the top surface 44 of the media 42 to flow into the U-shaped channel 26 in order to direct the liquids 23 away from the top surface 44 of the media 42. As shown in FIG. 3, the channel drain 12 has a pair of outwardly extending sections 50 at lower end 52 of the channel drain 12 are provided to help secure the channel drain 12 in the ground or other media 42. To further secure the channel drain 12 in the media, one or more stabilizers 54 can be attached to or integrally formed with the lower end 52 of the channel drain 12, as shown in FIG. 7. As best shown in FIGS. 1-3, the lower end 52 of the channel drain 12 and the outwardly extending sections 50 define a generally flat lower surface 56 of the channel drain 12.

For purposes of describing the use and relative location of the various components of the present invention, the terms "upper", "upward", "upwardly", "upper" and "top" and the like and the terms "lower", "downward", "downwardly" and "bottom" and the like refer to the direction of or toward, respectively, to the relative positions of the grate 30 mounted onto the upper ends 32 of the channel walls 24 of the channel drain 12 and the lower end 52 of the channel drain 52 in FIGS. 3-4. The lower surface 56 of the channel drain 12 is typically placed against the bottom of a channel or the like formed out of the media 42 and, as set forth above, the upper surface 46 of the grate 30 is generally at or near the top surface 44 of the media 42. The terms "rearward", "rearwardly", "back" or the like refer to or towards the rearward end 16 of the channel drain 12 and the terms "forward", "forwardly", "front" and the like refer to or towards the forward end 18 of the channel drain 12, with such terms reflecting the flow of water or other liquid along the flow path 28 from the rearward end 16 to the forward end 18 of the channel drain 12. The terms "right" and "left", as well as like terms, refer to the respective sides of the channel drain 12, prior art fittings 14 and other system parts 13 as referenced and understood by a person facing forwardly from the rearward end 16 of the channel drain 12, namely, facing toward the forward end 18 thereof.

As well known to persons who are skilled in the relevant art, the prior art fittings 14 are cooperatively dimensioned and configured with the size and shape of the channel walls 24 and U-shaped channel 26 of the channel drain 12 so the prior art fittings 14 will be securely held in place at an end 16/18 of the channel drain 12 by the grate 30 when the grate 30 is secured to the upper ends 32 of the channel walls 24. Specifically, the plate section 20 is cooperatively sized and configured such that the outer edges, referred to as first or right edge 58 and second or left edge 60, are generally aligned with, respectively, the first or right sidewall 24*a* and second or left sidewall 24*b* of the channel drain 12, as best shown in FIGS. 3-10. Each of the prior art fittings 14 have an inwardly directed coupler 62 that is inserted into the U-shaped channel 26, as shown in FIGS. 5-6, 8 and 10. As well known, the inwardly directed coupler 62 has a fitting body 64 that is dimensioned and configured such that the outer walls 66 of the fitting body 64 are in corresponding relation with the size and shape of the inner surface 25 of the channel walls 24 that form the U-shaped channel 26. Generally, the outer walls 66 of the fitting body 64 are in abutting relation with the inner surface 25 of the channel walls 24 when the inwardly directed coupler 64 is inserted inside the U-shaped channel 26 with the inwardly facing surface 68 of the plate section 20 in abutting relation with an end 16/18 of the channel drain 12 and the outwardly facing surface 70 directed forwardly from the end 16/18, as best shown in FIGS. 1, 7 and 9. The top of the outer walls 66 of the fitting body 64 is sized and configured in corresponding relation with the lower end 72 of the grate 30 (having upper end 74) such that when the grate 30 is secured to the channel drain 12, the lower end 72 of the grate 30 is in positioned in abutting relation with and presses down on the top of the outer walls 66 of the fitting body 64. The "snap" locking of the grate 30 to the upper ends 32 of the channel walls 24 tightly secures a prior art fitting 14 to the relevant end 16/18 of the channel drain 12, as shown in FIGS. 1, 7 and 9.

The component section 22 of the prior art fittings 14 is attached to or integrally formed with the outwardly facing surface 70 of plate section 20, as best shown in FIGS. 5-6, 8 and 10. In one configuration, the component section 22 of the prior art fittings 14 is sized and configured as a coupler, shown as 22*a* in FIGS. 1 and 5-6, that extends outwardly from the outwardly facing surface 70. The coupler 22*a* is sized and configured in the same as the inwardly directed coupler 64 that is received inside the U-shaped channel 26 of a channel drain 12. The coupler 22*a* of a prior art fitting 14 is utilized to connect one section of a channel drain 12 to another section of channel drain 12. Specifically, a prior art fitting 14 that is configured with a component section 22 configured as a coupler 22*a* and being positioned at the second/forward end 18 of a channel drain 12, as shown in FIG. 1, will be able to connect to a second section of channel drain 12 (not shown) by inserting the coupler 22*a* of the prior art fitting 14 into the U-shaped channel 26 of the second channel drain 12 and be securely engaged thereto by locking the grate 30 to the second channel drain 12 (as described above), thereby securely connecting the two sections of channel drain 12 together.

Figure 8:
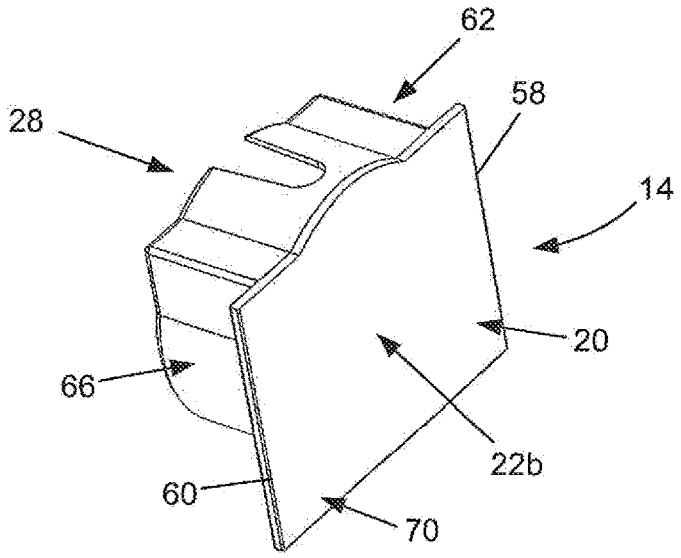
FIG. 8 (PRIOR ART)
FIG. 8 is a forward end perspective view of the prior art end wall fitting of FIG. 7.
Figure 10:
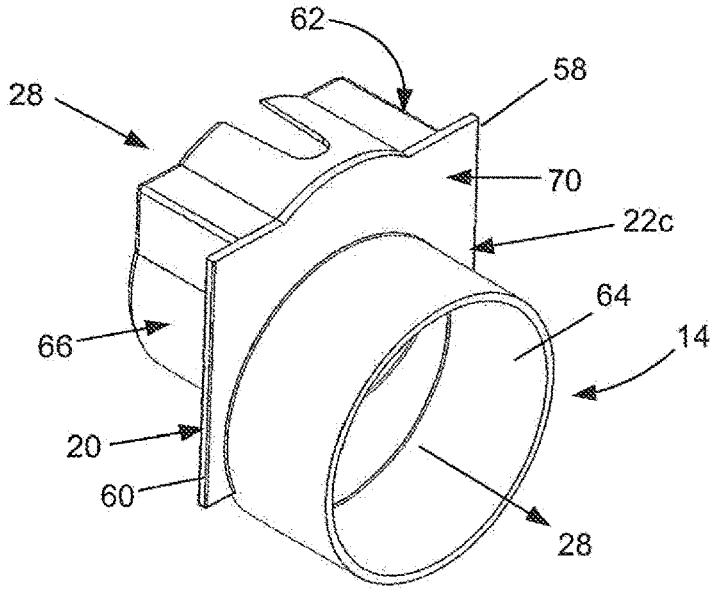
FIG. 10 (PRIOR ART)
FIG. 10 is a forward end perspective view of the prior art adapter fitting of FIG. 9.

As well known to persons who are skilled in the relevant art, a wide range of different types of component sections 22, at the outwardly facing surface 70 of the plate section 20, can be utilized with prior art fittings 14. As examples, FIGS. 7-8 show the use of a solid end wall 22*b* as the coupler section 22 of the prior art fitting 14 and FIGS. 9-10 show the use of an adapter 22*c* as the coupler section 22 of the prior art fitting 14. The end wall 22*b* stops forward flow of the water or other liquid along flow path 28. The adapter 22*c* connects a channel drain 12 to a pipe, other drains and the like. The coupler 22*a*, end wall 22*b* and adapter 22*c* are only provided as exemplary component sections 22 for a prior art fitting 14. As such, persons who are skilled in the relevant art will readily appreciate that the component section 22 of the prior art fitting 14 can be a tee, cross, elbow, bottom outlet discharge adapter and the like for use in a channel drain systems 11.

As set forth in the Background, one issue for persons who install channel drain systems 11 is that must have with them numerous channel couplers and other prior art fittings 14 with different types of component sections 22, as well as a series of individual channel lengths and the appropriate grates. In order for the person (the installer) to efficiently connect sections of channel drains together and to connect to other system parts 13 of a channel drain system 11, the installer has to have all of the possible couplers and fitting with him or her. Failure to plan ahead and/or to anticipate the need for properly sized and configured prior art fittings 14, will require the installer to return to his or her shop or go to a store to obtain the necessary fittings 14 to finish installing the channel drain system 11. As set forth in the Summary and in more detail below, the universal channel drain fitting 10 of the present invention solves this problem by allowing an installer to easily have with him or her and to easily configure all of the different sizes fittings that will be needed to complete a channel drain system 11.

Figure 11:
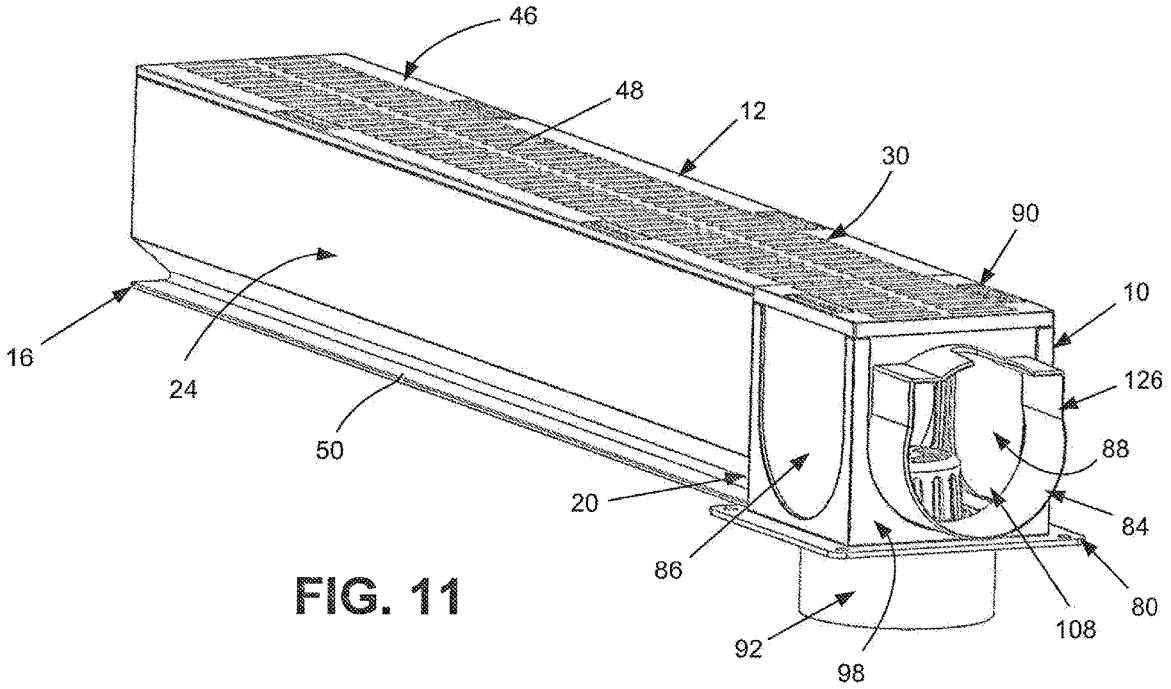
FIG. 11 is a forward end perspective view of a universal channel drain fitting configured according to a first embodiment of the present invention having a coupler at the forward end thereof, with the new fitting shown attached to the prior art channel drain of FIG. 8.
Figure 12:
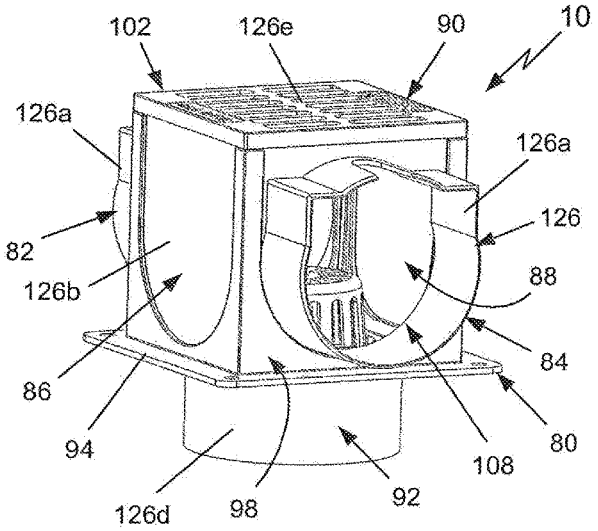
FIG. 12 is a forward end perspective view of the universal channel drain fitting of FIG. 11.
Figure 13:
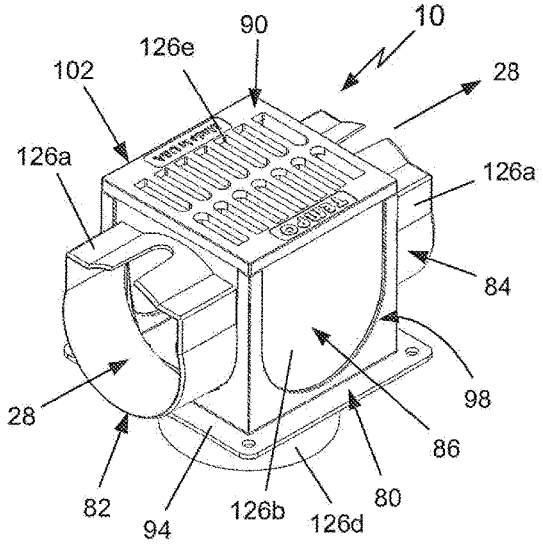
FIG. 13 is a rearward end perspective view of the universal channel drain fitting of FIG. 12.
Figure 14:
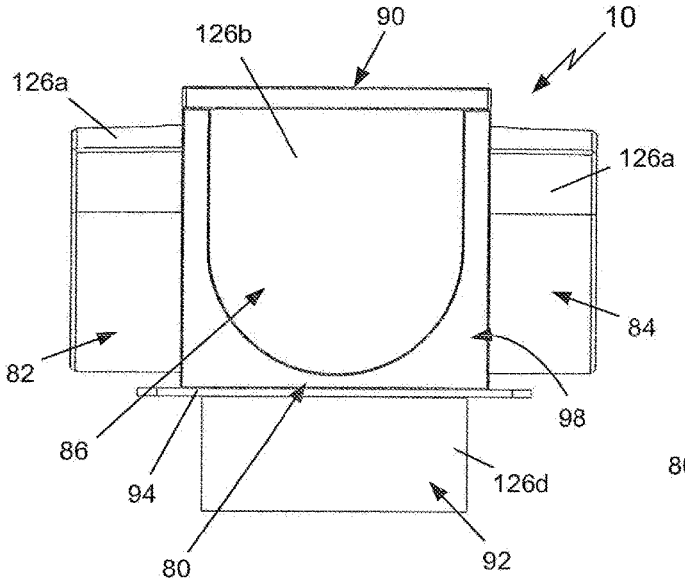
FIG. 14 is a right side view of the universal channel drain fitting of FIG. 12, with the left side view being the same.
Figure 15:
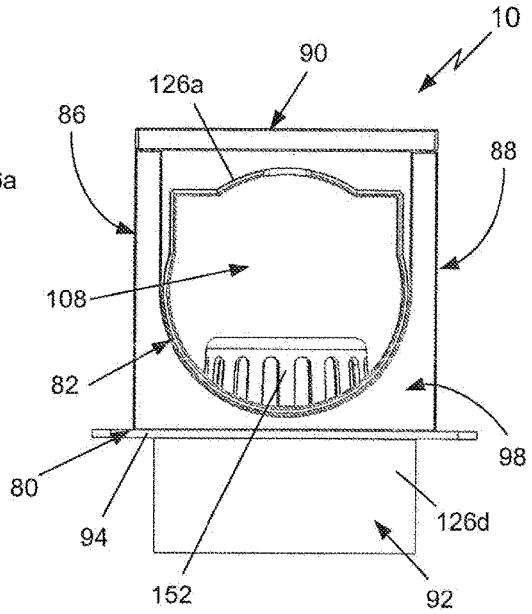
FIG. 15 is a forward end view of the universal channel drain fitting of FIG. 12, with the rearward end view being the same.
Figure 16:
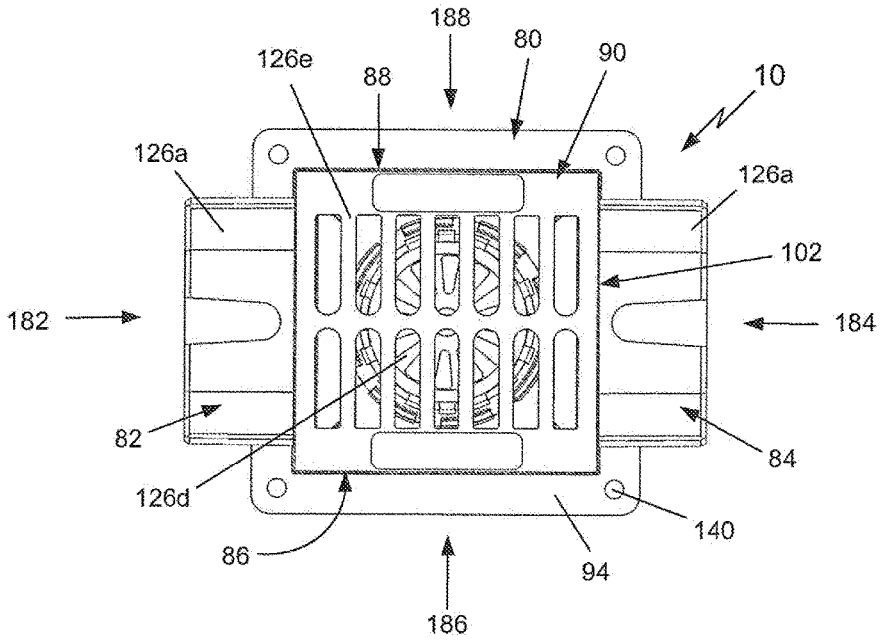
FIG. 16 is a top view of the universal channel drain fitting of FIG. 12.
Figure 17:
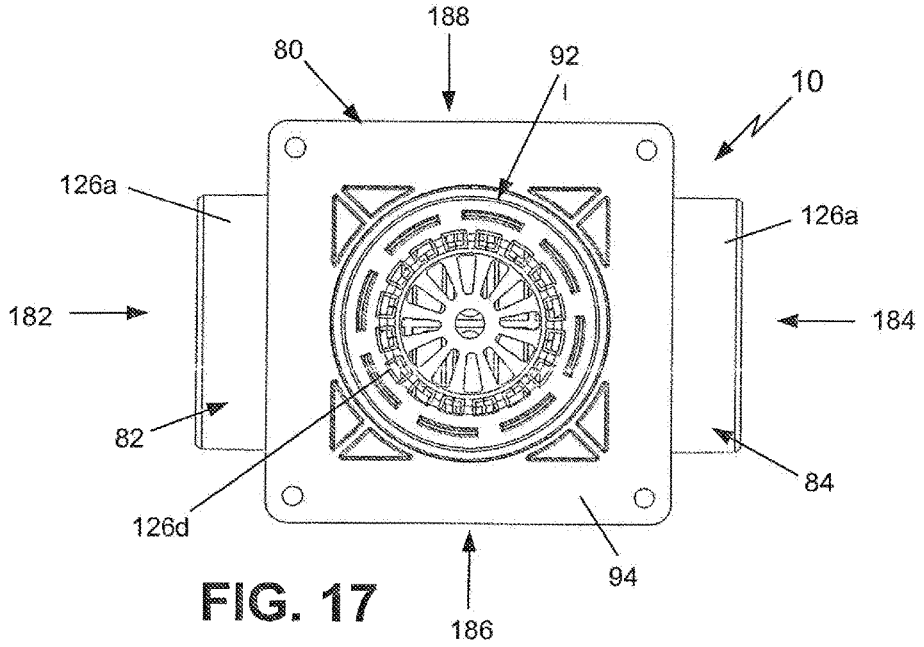
FIG. 17 is a bottom view of the universal channel drain fitting of FIG. 12.

Examples of universal channel drain fittings 10 that are structured and arranged in accordance with one or more of the preferred embodiments of the present invention are shown in FIGS. 11-49. As set forth in more detail below, the new universal fitting 10 generally comprises a base 80, and a plurality of specially configured side, end and bottom caps, namely, a first or rearward end cap 82, a second or forward end cap 84, a first or right side cap 86, a second or left side cap 88, a top cap 90 and a bottom cap 92. The base 80 has a base panel 94 with an opening 96 disposed in the base panel 94 and a upwardly extending leg assembly 98 attached to or integrally formed (likely preferred) with the base panel 94. As explained below, the opening 96 is cooperatively sized and configured to be engaged by the bottom cap 92 and the leg assembly 98 has a plurality of leg members 100 that extend upward from the base panel 94 and are cooperatively structured and arranged to receive the end caps 82/84, side caps 86/88 and top cap 90. The top cap 90, which in a typical embodiment will be a modified grate plate 102 (as shown in FIGS. 12-13 and 16) relative to grate 30 that is utilized in the prior art channel drain 12, engages the leg assembly 98 of base 90 and all of the end caps 82/84 and side caps 86/88 in a manner which holds the universal fitting 10 together for use as a fitting in a channel drain system 11 having at least one prior art channel drain 12. As with the prior art fittings 14, the new universal fitting 10 is utilized to connect two sections of channel drain 12 together end-to-end and/or to connect a channel drain 12 to drains, pipes and various other system parts 13 of a channel drain system 11.

Figure 18:
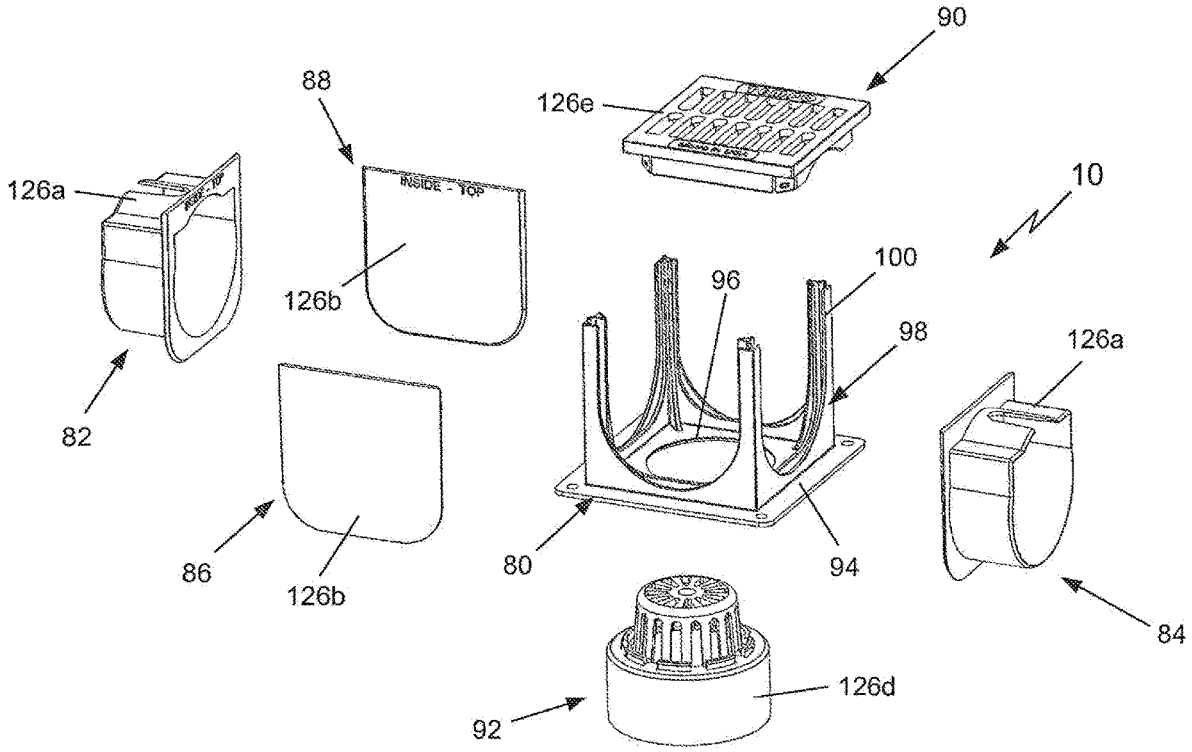
FIG. 18 is an exploded view of the universal channel drain fitting of FIG. 12.
Figure 19:
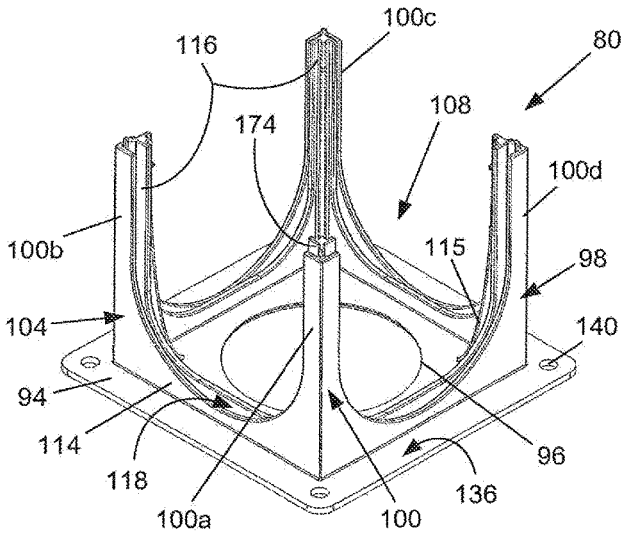
FIG. 19 is a top perspective view of the base of the universal channel drain fitting of FIG. 18.
Figure 20:
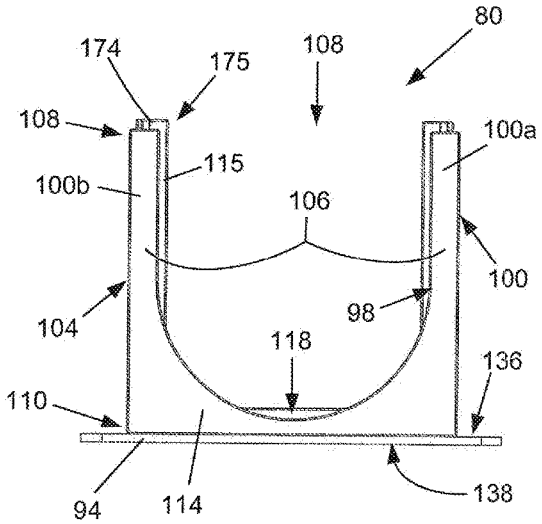
FIG. 20 is a right side view of the base of the universal channel drain fitting of FIG. 19, with the left side view and both end views being the same.
Figure 48:
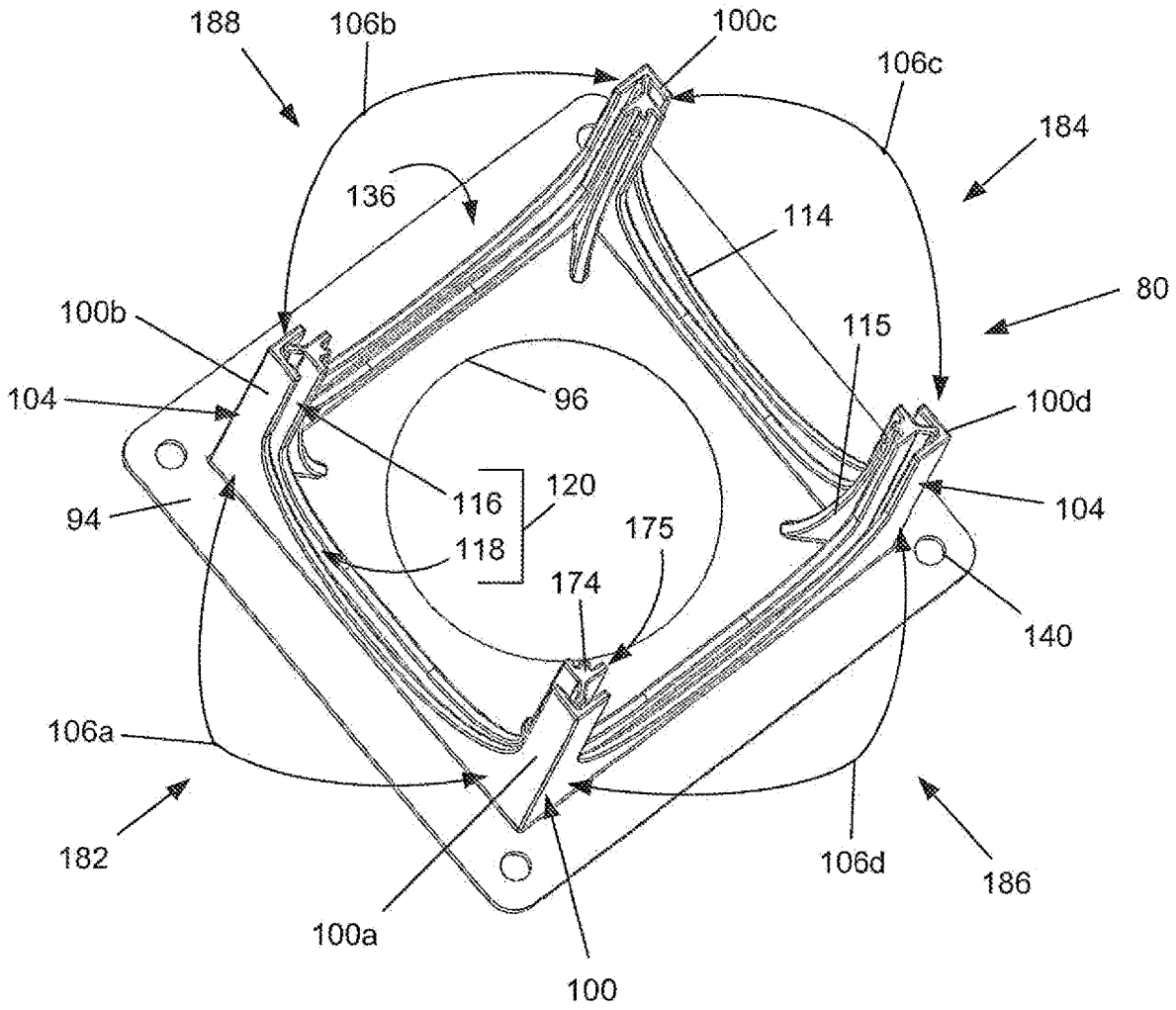
FIG. 48 is a top perspective view of the base of the universal channel drain fitting of FIG. 18 particularly showing the leg members and leg member pairs thereof.

In the preferred configurations, the universal fitting 10 of the present invention is sized and configured to be utilized with standard sized and configured channel drains 12 and other standard sized and configured system parts 13 that are utilized in a typical channel drain system 11. However, as will be readily appreciated by persons who are skilled in the relevant art, the universal fitting 10 can be easily modified so as to be utilized in a channel drain system 11 having non-standard sized and configured channel drains 10 and other drain system parts 13. As will also be readily appreciated by such persons, such ease of incorporating modifications is one of the primary benefits of the new universal fitting 10. As set forth above, the base 80 supports the end caps 82/84, side caps 86/88, top cap 90 and bottom cap 92 to connect sections of channel drain 12 together and to connect a channel drain 12 to other system parts 13 of a channel drain system 11. To accomplish the objectives of the present invention, the base 80 has a substantially planar base panel 94 with a leg assembly 98 that is attached to or integral with the base panel 94 and configured to be generally positioned around the opening 96 in the base panel 94, as best shown in FIGS. 18-22. The leg assembly 98 is configured for the leg members 100 to extend generally upward from the base panel 94. In the likely preferred embodiment, the leg assembly 98 has four leg members 100, shown as first leg member 100*a*, second leg member 100*b*, third leg member 100*c* and fourth leg member 100*b*, as shown in FIGS. 19, 20 and 48. The leg assembly 98 is configured such that the leg members 100 are structured and arranged for each leg member 100 to be adjacent a second leg member 104 to form a plurality of leg member pairs 106, as best shown in FIG. 20. Each leg member pair 106 is associated with one of the end caps 82/84 and side caps 86/88 to receive and support these caps 82/84/86/88 on the base 80, as set forth in more detail below, to form the desired functional universal fitting 10 desired by the installer or other person associated with a channel drain system 11. For purposes of describing the universal fitting 10 of the present invention, the first leg member 100*a* and second leg member 100*b* form a first leg member pair 106*a* that supports the first/rearward end cap 82, the second leg member 100*b* and third leg member 100*c* form a second leg member pair 106*b* that supports the second/left side cap 88, the third leg member 100*c* and fourth leg member 100*d* third leg member pair 106*c* supports the second/forward end cap 84 and the fourth leg member 100*d* and first leg member 100*a* form a fourth leg member pair 106*d* that supports the first/right side cap 86, as best shown with regard to FIGS. 11-15 and 48. When each of the end caps 82/84, side caps 86/88, top cap 90 and bottom cap 92 are in place on the base 80, an interior area 108 is formed (as shown in FIGS. 19-20) to receive water or other liquid 23 from the flow path 28 from a channel drain 12 or other system part 13 to control the continued flow of the liquid 13, such as to allow the liquid 23 to pass through the universal fitting 10 to another channel drain 12 or other system component part 13 or to stop the flow of the liquid 23 by using a solid plate component 22*b* or like component) at an end of a line in the channel drain system 11.

Figure 21:
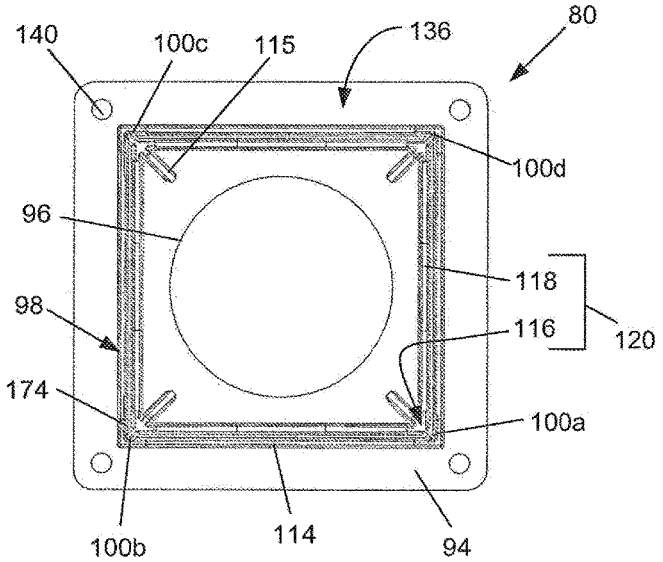
FIG. 21 is a top view of the base of the universal channel drain fitting of FIG. 20.
Figure 22:
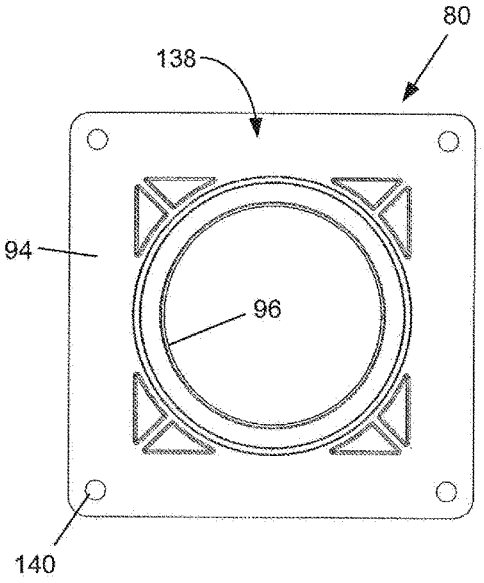
FIG. 22 is a bottom view of the base of the universal channel drain fitting of FIG. 20.

As best shown in FIGS. 19-22, the base panel 94 is generally planar and horizontally disposed when the universal fitting 10 is in use. In a preferred embodiment, the opening 96 is generally circular and centrally disposed in the base panel 94 with the leg members 100 of the leg assembly 98 positioned around the opening 96 on base panel 94, as best shown in FIGS. 21-22. However, as will be readily appreciated, the opening 96 can be square, rectangle or virtually any other shape and/or positioned elsewhere on the base panel 94. As set forth in more detail below with regard to the bottom cap 92, the opening 96 is cooperatively configured with the bottom cap 92 for the bottom cap 92 to be quickly and easily attached to the base 80 by engaging the opening 96. Each leg member 100 has a lower end 110 and an upper end 112, as best shown in FIGS. 19-20, with the lower ends 110 at or near the base panel 94 and the upper ends 112 vertically disposed above and in spaced apart relation above the base panel 94 to receive and engage the top cap 90. In the embodiment shown in the figures, the lower ends 110 of the four leg members 100 are connected together with a leg base 114 as part of the leg assembly 98. As will be readily appreciated, however, different configurations and positioning are possible for the opening 96, leg assembly 98 and the various leg members 100 of the base 80.

As set forth above, the leg assembly 96 is structured and arranged to receive and support each of the end caps 82/84 and side caps 86/88 between each leg member pair 106, comprising a leg member 100 and a second/adjacent leg member 104, wherein each leg member 100 is considered both a leg member 100 and a second/adjacent leg member 104 depending on the reference to the leg member 100. Each leg member 100 has a slot member 115 that define a pair of slots 116, each being at about a right angle to the other, that extend down from the upper end 112 of the leg member 100 to the lower end 110 thereof. As best shown in FIGS. 19-21, the slot 116 on one leg member 100 faces towards the slot 116 of one of the two second/adjacent leg members 104, which two leg members 100/104 define a leg member pair 106 that define a pair of spaced apart leg slots 116 that face towards each other. In a preferred embodiment, the leg base 114 also has a slot 118 that interconnects the slots 116 in a leg member pair 106. The pair of leg slots 116 in legs 100/104 and the associated slot 118 in leg base 114 form a slot group 120 (as shown in FIGS. 19-21 and 48) that, as explained below, extends between each leg member pair 106 to receive one of the end caps 82/84 and side caps 86/88 along a leg member pair 106 and into slot 118 of leg base 114.

As best shown in 11-15 and 23-47, each of the end caps 82/84, side caps 86/88, top cap 90 and bottom cap 92 comprise a plate section 124 and a component section 126 that, as with plate section 20 and the component section 22 of the prior art fittings 14, allow the each of the end caps 82/84, side caps 86/88, top cap 90 and bottom cap 92 to be associated with the base 80 and to provide the desired hydraulic functions for the universal fitting 10 of the present invention. Unlike the prior art fittings 14, however, the plate section 124 of the end caps 82/84 and side caps 86/88 are securely engaged with, as opposed to being merely pressed against an end 16/18 of a drain channel 12, the leg assembly 98 of the base 80 to hold the end caps 82/84 and side caps 86/88 in their respective positions on the base 80. In the preferred embodiment of the new universal fitting 10, the plate section 124 is sized and configured to be slidably received downward into the slots 116 of a leg member pair 106 and then into the slot 118 of the leg base 114 that define a single slot group 120 to hold the subject end caps 82/84 or side caps 86/88 in an upright position in the leg assembly 98 of the base 80, as shown in FIGS. 11-15. Placement of the top cap 90 onto the leg assembly 98, by engaging the upper ends 112 of the leg members 10 (as described below), tightly secures the end caps 82/84 and side caps 86/88 in their respective locations by effectively locking the top cap 90 to the leg assembly 98 of the base 80. In the embodiment shown in the figures, the engagement of the bottom cap 92 with the opening 96 in the base panel 94 does not affect the placement of the end caps 82/84 and side caps 86/88 on the leg assembly 98.

To accomplish the above, the plate section 124 of the universal fitting 10 is dimensioned in corresponding relation with the leg assembly 98 so the end caps 82/84 and side caps 86/88 can be slidably received by the leg assembly 98 to form the universal fitting 10. Specifically, as shown with regard to the embodiment of FIGS. 23-40, the plate section 124 has a first edge 128 and a second edge 130 that are sized and configured to slide into the slots 116 associated with the leg members 100, a top edge 132 that is sized and configured to be engaged by the top cap 90 and a bottom edge 134 that is sized and configured to be received in the slot 118 of the leg base 114 to hold the end caps 82/84 and side caps 86/88 in the leg assembly 98. Even more specifically, the plate section 124 of the end caps 82/84 and side caps 86/88 of the universal fitting 10 are dimensioned to slidably engage the slot group 120 associated with a leg member 100 and its associated second/adjacent leg members 104 such that when the bottom edge 134 thereof is received in the bottom of the slot 118 in the leg base 114, the top edge 132 is at least generally aligned with the upper end 112 of each of the leg members 100 below the upwardly extending top post 174, discussed below, to which the top cap 90 securely connects, as best shown in FIGS. 11-15.

As will be readily understood by persons who are skilled in the relevant art, when the end caps 82/84 and side caps 86/88 are received in a slot group 120 (e.g., a pair of slots 116 and slot 118 therebetween), the lower area of plate section 124 of the end caps 82/84 and side caps 86/88 are securely received in the slot 118 of the leg base 114. In another embodiment (not shown), the leg members 100 could be directly attached to or integral with the base panel 94 (e.g., no leg base 114 and no slot 118 in the leg base 114) such that the bottom edge 134 of the plate section 124 of the end caps 82/84 and side caps 86/88 slide down the slots 116 in the leg members 100/104 and directly abut the upper surface 136 of the base panel 94 (instead of the bottom of slot 118 of leg base 114). However, it is believed that receiving the bottom edge 134 and lower area of the plate section 124 of the end caps 82/84 and side caps 86/88 into the "groove" defined by the slot 118 in the leg base 114 more effectively holds the end caps 82/84 and side caps 86/88 in place and better prevents or at least substantially reduces the likelihood of leakage of water or liquid through the universal fitting 10 when it is in use in a channel drain system 11 to move liquid away from a place where the liquid is not wanted. In the embodiment shown in the figures, the lower portion of the plate section 124 has curved transitions between the bottom edge 134 and the two side edges 128/130 that match the curved transition between the slots 118 of the leg base 114 and the slots 116 in the leg members 100, as best shown in FIGS. 18, 24-26, 28 and 30.

In addition to the upper surface 136, the base panel 94 has a lower surface 138 that is placed against the bottom surface of a trench or other area where the channel drains 12 and universal fittings 10 are placed below the top surface 44 of the media 42. If desired, the base panel may have one or more apertures 140 therethrough that can be utilized with connectors to securely attach the universal fitting 10 to the lower surface of the trench to help stabilize the channel drain system 11, much in the same manner as the apertures in the stabilizers 54 do for the channel drains 12.

Figure 23:
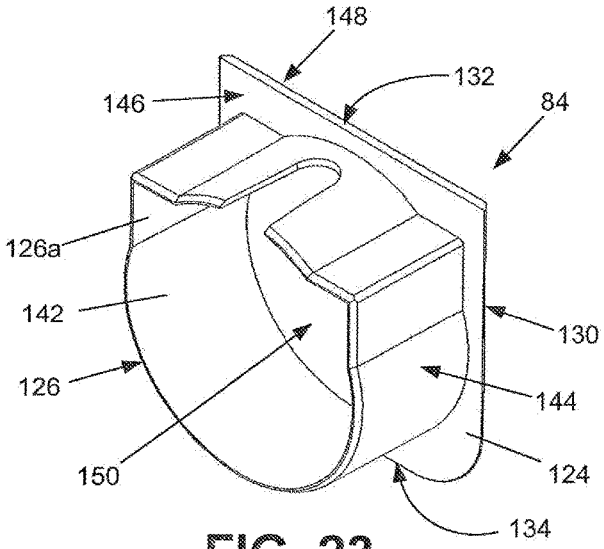
FIG. 23 is a perspective view of the first or rearward end cap of the universal channel drain fitting of FIG. 18, with the end cap configured as a coupler and the second or forward end cap being the same (though reversed)
Figure 24:
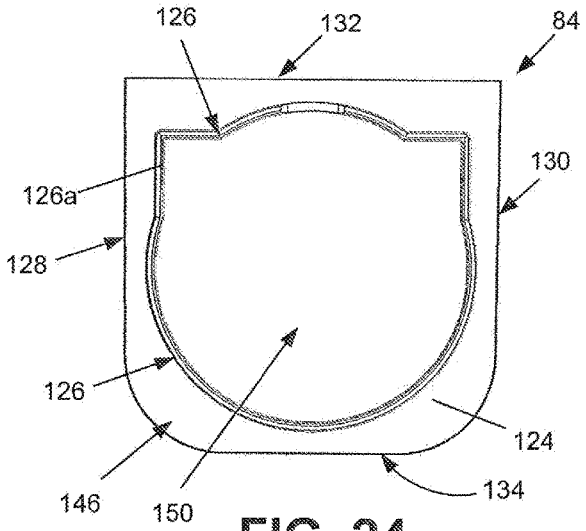
FIG. 24 is an end view of the rearward end of the end cap of FIG. 23.
Figure 25:
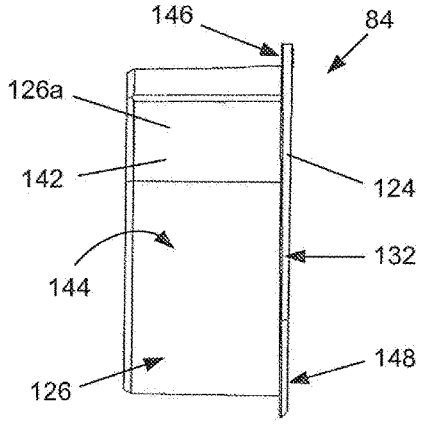
FIG. 25 is a side view of the end cap of FIG. 23.
Figure 26:
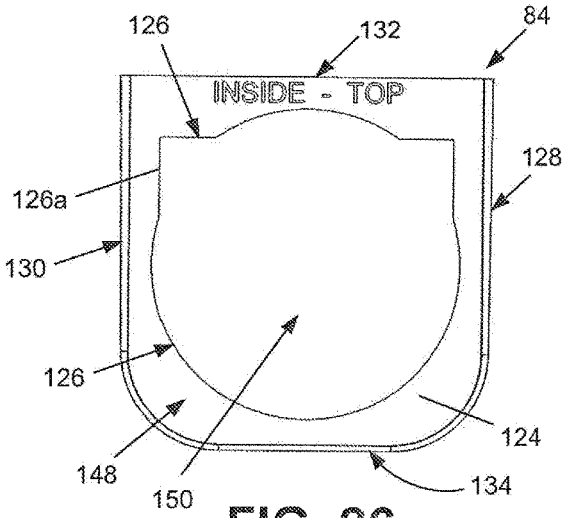
FIG. 26 is an end view of the forward end of the end cap of FIG. 23.
Figure 27:
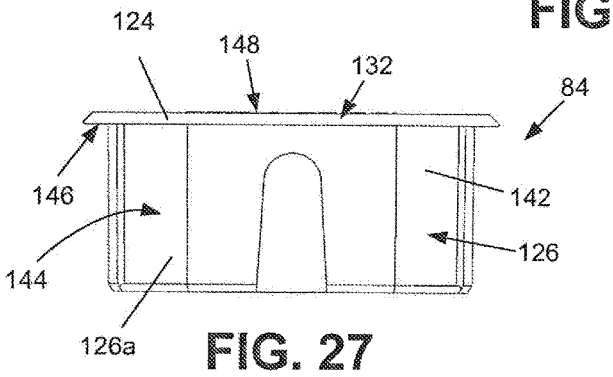
FIG. 27 is a top view of the end cap of FIG. 23.
Figure 28:
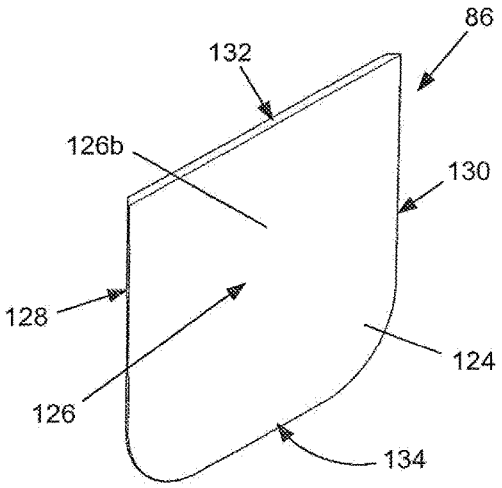
FIG. 28 is a side perspective view of the first or right side cap of the universal channel drain fitting of FIG. 18, with the side cap configured as a solid sidewall and the second or left side cap being the same (though reversed)
Figure 29:
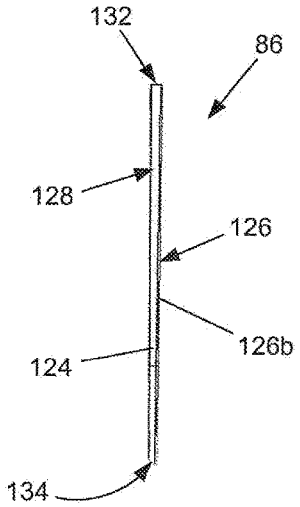
FIG. 29 is an end view of the side cap of FIG. 28.
Figure 30:
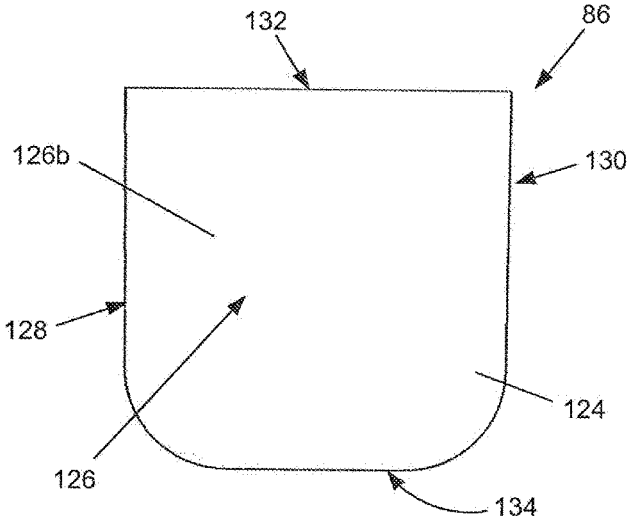
FIG. 30 is a side view of the side cap of FIG. 28.
Figure 31:
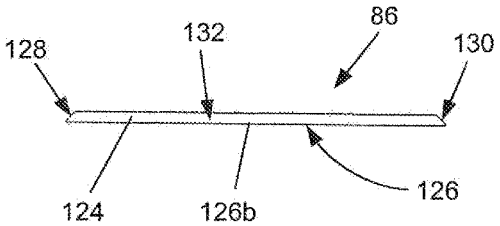
FIG. 31 is a top view of the side cap of FIG. 28.

As shown in FIGS. 11-27 and 48, in the typical embodiments of the universal fitting 10 of the present invention, the component section 126 of the first/rearward end cap 82, which is engaged with the first leg member pair **106*a* by sliding down and into the slot group 120 thereof, is sized and configured the same manner as the inwardly directed coupler 62 of the prior art fittings 14 so that the component section 126 of the first/rearward end cap 82 will fit into and engage the U-shaped channel 26 of the forward end 18 of a rearward disposed channel drain 12. More specifically, as set forth above with regard to the inwardly directed coupler 126, the component section 126 of the first/rearward end cap 82 is a coupler 126*a* has a fitting body 142 that is dimensioned and configured such that the outer walls 144 of the fitting body 142 are in corresponding relation with the size and shape of the inner surface 25 of the channel walls 24 that form the U-shaped channel 26 so the fitting body 142 will fit snugly inside the U-shaped channel 26 at the forward end 18 of the rearwardly disposed channel drain 12. Generally, the outer walls 144 of the fitting body 142 are in abutting relation with the inner surface 25 of the channel walls 24 when coupler 126***a* is inserted inside the U-shaped channel 26. With the plate section 124 engaged with the slot group 120 defined by the first leg member pair 100*a*, the inwardly facing surface 146 of the plate section 124 is in abutting relation with the forward end 18 of the channel drain 12, as shown in FIG. 11. The inwardly facing surface 148 of the plate section 124 faces inward to the interior area 108 of the universal fitting 10, as shown in FIGS. 23-24 and 26. The fitting body 142 of the coupler 126*a* defines a channel 150 into the interior area 108 of the universal fitting 10 that is hydraulically connected to the flow path 28 defined by the U-shaped channel 26 of the channel drain 12 to allow water or other liquid 23 to flow into and, depending on the configuration of the second end cap 84 and the side caps 86/88, through the universal fitting 10. If the circumstance arises, a different type of component section 126 can be utilized for the first/rearward end cap 82 that is engaged with the first leg member pair 106*a*.

In the embodiment of the universal fitting 10 shown in FIGS. 11-16, the component section 126 of the second/forward end cap 84 is configured exactly the same (typically) as the component section 126 of the first/rearward end cap 82 described above, except having the coupler 126 facing in the opposite direction. Specifically, the second/forward end cap 84 utilizes the same plate section 124 and component section 126 (namely, coupler 126*a*) as the first/rearward end cap 82. As such, the second/forward end cap 84 is slidably engaged and positioned in the third leg member pair 106*c* with the coupler 126*a* that defines the component section 126 facing forwardly so the coupler 126*a* can be inserted into a U-shaped channel 26 at the first/rearward end 16 of a forwardly positioned channel drain 12 in a channel drain system 11 to connect therewith in a manner which will continue the flow path 28 for the continued flow of water or other liquids 23 through the system 11. As the arrangement of the channel drain system 11 may prescribe, a different type of component section 126 can be utilized for the second/forward end cap 84 that is engaged with the third leg member pair 106*c*. Examples of such alternative component sections 126 are described below.

With regard to the embodiment of the new universal fitting 10 shown in FIGS. 11-16, the component section 126 of the first/right side cap 86 (as well as the second/left side cap 88) is configured as a solid plate 126*b* which is integrally formed with the plate section 124, as best shown in FIGS. 28-31. As set forth above, the first/right side cap 86 is receivedly engaged by the second leg member pair 106*b* and the second/left side cap 88 is receivedly engaged by the fourth leg member pair 106*d* by sliding down and into the associated slot group 120. As will be readily appreciated by persons who are skilled in the relevant art, the solid plate 126*b* of the component section 126 of the two side caps 86/88 is structured and arranged to prevent flow of water or other liquids 23 through the otherwise open areas defined by the second leg member pair 106*b* and the fourth leg member pair 106*d* by blocking those open areas (e.g., no channel 150) such that liquid will not flow out the universal fitting 10 in those directions. As the arrangement of the channel drain system 11 may prescribe, a different type of component section 126 can be utilized for the first/right side cap 86 that is engaged with the second leg member pair 106*b* and/or the second/left side cap 88 that is engaged with the fourth leg member pair 106*d*. Examples of such alternative component sections 126 are described below.

Figure 32:
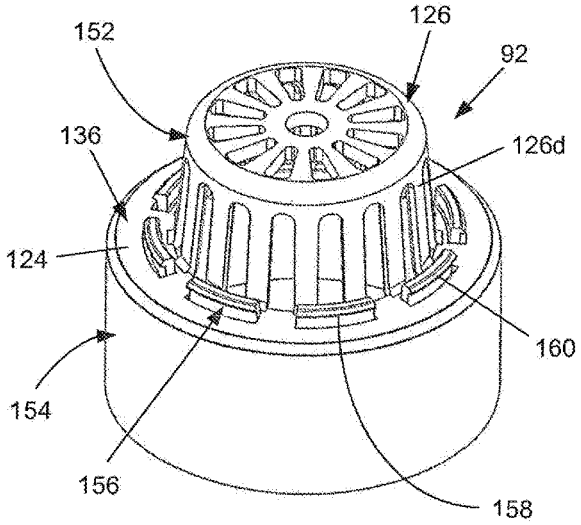
FIG. 32 is a top perspective view of the bottom cap of the universal channel drain fitting of FIG. 18, with the bottom cap configured as a bottom drain.
Figure 33:
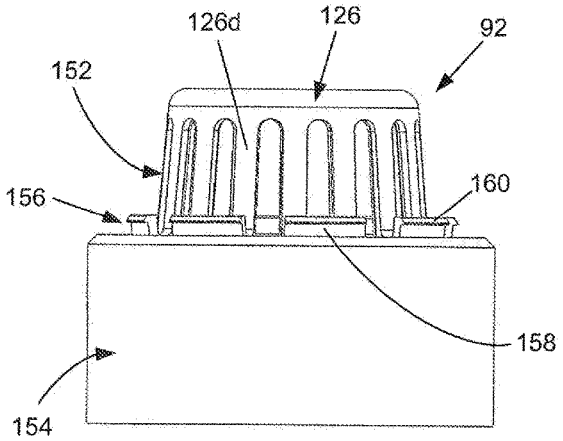
FIG. 33 is a side view of the bottom cap of FIG. 32.
Figure 34:
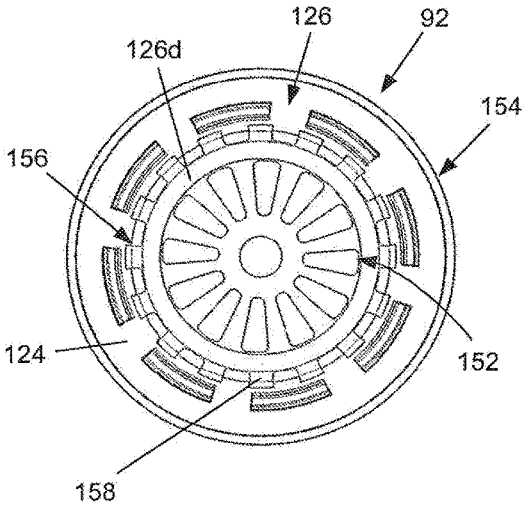
FIG. 34 is a top view of the bottom cap of FIG. 32.

The embodiment of the new universal fitting 10 shown in FIGS. 11-16 has a bottom cap 92 with a component section 126 that is configured as a bottom drain 126*d* that is structured and arranged to allow all or some of the water or other liquids 23 flowing along the flow path 28 downward in a manner that directs the liquid below the top surface 44 of the media 42 below the universal fitting 10. More specifically, the bottom drain 126*d* has an upper section 152 which is configured with a plurality of drainage openings to screen out leaves, twigs and other materials from the downward directed flow and a lower section 154 that is configured as a substantially open pipe to efficiently direct the liquid to the area below the universal fitting 10, as best shown in FIGS. 32-34. For some bottom drains 126*d*, the bottom drain 126*d* may not have an upper section 152 to screen any materials. The configuration and use of bottom drains 126*d* are well known to persons who are skilled in the relevant art. As set forth above, in a preferred embodiment of the present invention, the bottom cap 92 is structured and arranged to be received in and engage the opening 96 in the base panel 94 to secure the bottom cap 92 to the lower surface 138 of the base panel 94 of base 80, as best shown in FIGS. 11-17. To accomplish the desired engagement, the bottom cap 92 has an integrally formed plate section 124 with an inwardly facing surface 146, with the plate section 124 positioned to function as the interface between the upper section 152 and lower section 154 of the bottom drain 126*d*, having an opening engaging mechanism 156 that is cooperatively configured with the opening 96 in the base panel 94 to engage the panel opening 96, as best shown in FIGS. 18 and 32-34. Specifically, the opening engaging mechanism 156 is cooperatively configured to engage the opening 96, whether the opening 96 is round, square, rectangular or any other shape. In the embodiment shown in the figures, the opening engaging mechanism 156 has a plurality of flexible clip members 158 that are circularly positioned to engage the round shaped opening 96 in the base panel 94, as best shown in FIGS. 18, 32 and 34. Each of the clip members 158 have a outwardly extending lip 160 that tightly engages the opening 96 after the clip members 158 are pushed upward through opening 96 to position the inwardly facing surface 148 of the plate section 124 against the lower surface 138 of the base panel 94, with the lip 160 against the upper surface 136 thereof, and hold the bottom cap 92 in place against and below the base 80, as shown in FIGS. 11-15 to form this part of the universal fitting 10.

As will be readily appreciated by persons who are skilled in the relevant art, the arrangement of the channel drain system 11 may prescribe a different type of component section 126 for the bottom cap 92 that is engaged with the opening 96 in the base panel 94. An example of an alternative component section 126 for the bottom cap 92, a solid plate 126*b*, is described below with regard to FIGS. 41-44. In addition, persons who are skilled in the relevant art will also readily appreciate that different types of opening engaging mechanisms 156 can be utilized to secure the bottom cap 92 to the opening 96 in the base panel 94 of the base 80 and the bottom cap 92 can be configured to engage the panel opening 96 from the upper surface 136 of the base panel 94 (e.g., be positioned in the interior area 108). For instance, the bottom cap 92 can be provided with a threaded section that is configured to threadably engage a threaded section at or near the opening 96 so the installer merely has to thread the bottom cap 92 onto the base panel 94. Alternatively, the plate section 124 of bottom cap 92 can have a plurality of connectors that are configured to engage a plurality of cooperatively configured components associated with the base panel 94, such as on the lower surface 138 thereof. These connectors can be similar to snaps, screws, bolts, rivets and the like. Although such connectors are a possible configuration, the are not likely to be preferred as they generally require the use of tools to put together the desired universal fitting 10. As set forth above, in the preferred configurations of the universal fitting 10 (including use of clip members 158 and being threadably configured), the various caps 82/84/86/88/90/92 and the base panel 94 are each structured and arranged to not require the use of tools or other mechanisms to join the required caps 82/84/86/88/90/92 to the base 80.

An alternative configuration for the bottom cap 92 is shown in FIGS. 41-44. In this embodiment, the component section 126 of the bottom cap 92 is configured as a solid plate 126*b* that prevents the flow of water and/or other liquids 23 out the bottom of the universal fitting 10. The opening engaging mechanism 156, comprising a plurality of clip members 158 with outwardly extending lips 160 (as described above for the bottom drain 126*d*), is positioned on the inner surface of the solid plate 126*b*. As described above, the outwardly extending lips 160 of the clip members 158 will be received through and engage the opening 96 in the base panel 94 to securely attach the bottom cap 92 to the base 80.

Figure 35:
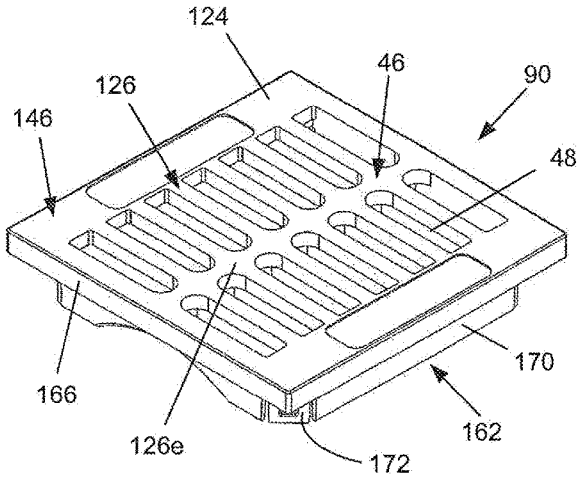
FIG. 35 is a top perspective view of the top grate of the universal channel drain fitting of FIG. 18.
Figure 36:
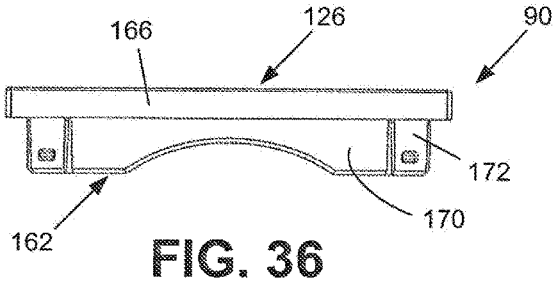
FIG. 36 is an end view of the top grate of FIG. 34.
Figure 37:
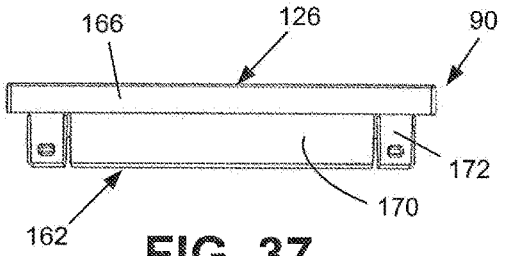
FIG. 37 is a side view of the top grate of FIG. 34.
Figure 38:
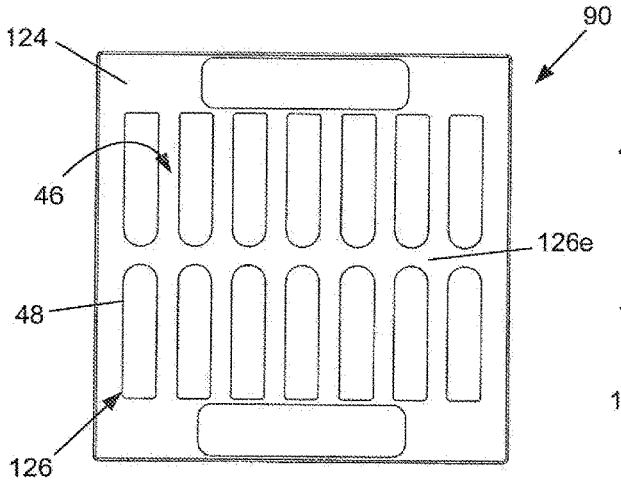
FIG. 38 is a top view of the top grate of FIG. 34.
Figure 39:
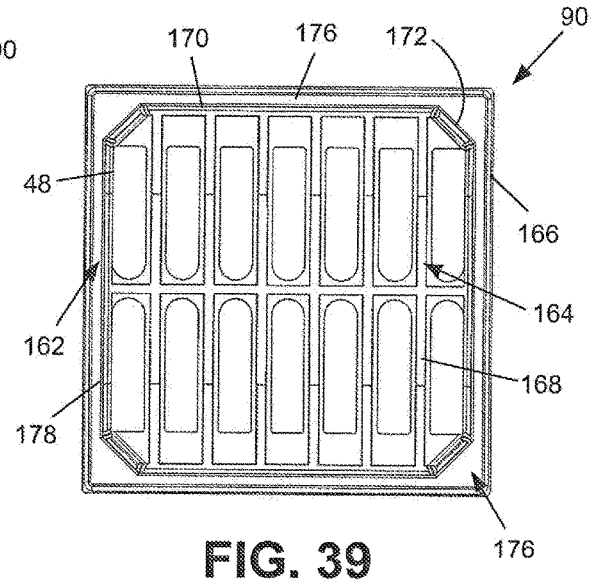
FIG. 39 is a bottom view of the top grate of FIG. 34.
Figure 40:
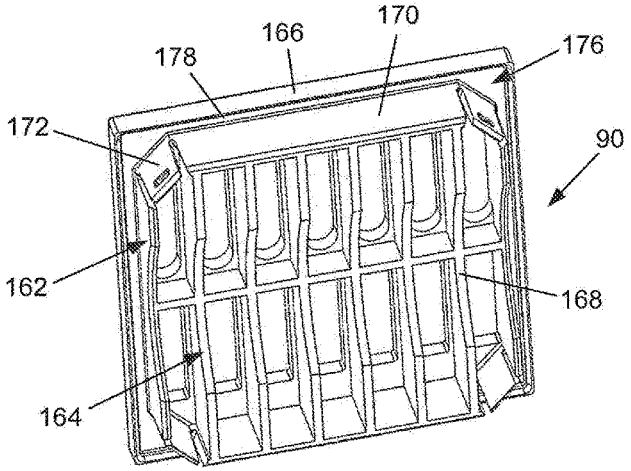
FIG. 40 is a bottom perspective view of the top grate of FIG. 39.
Figure 41:
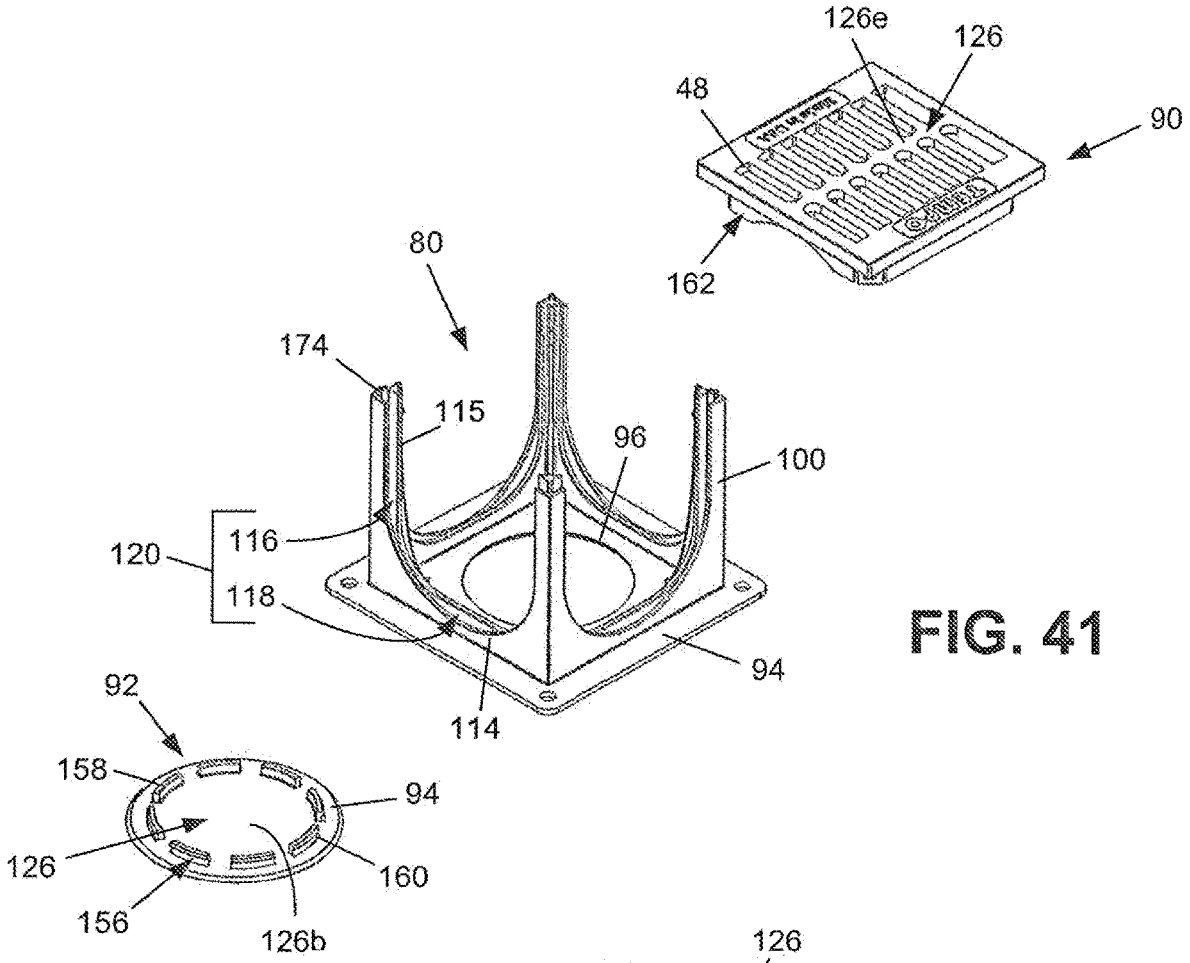
FIG. 41 is an exploded side perspective of a second embodiment of the universal channel drain fitting of the present invention, with the bottom cap configured as a solid bottom wall and the end caps and side caps not shown.
Figure 42:
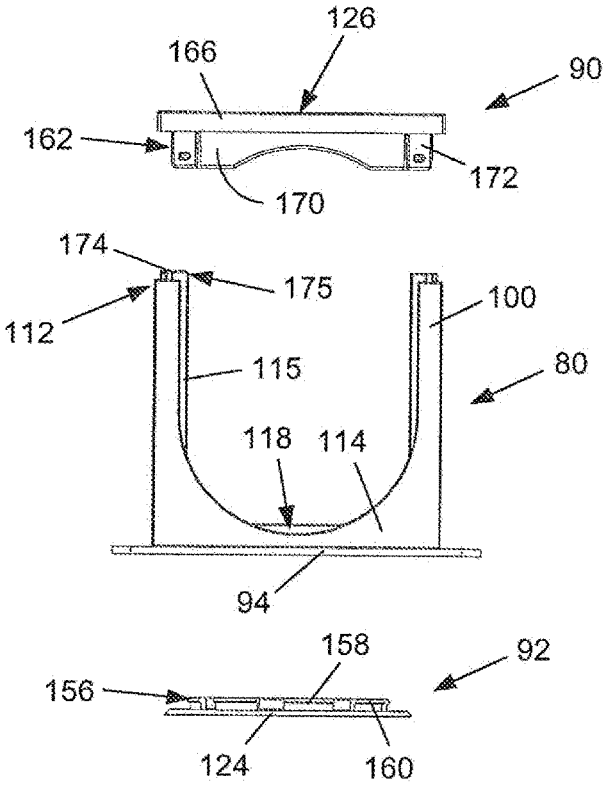
FIG. 42 is an exploded side view of the universal channel drain fitting of FIG. 41.
Figure 43:
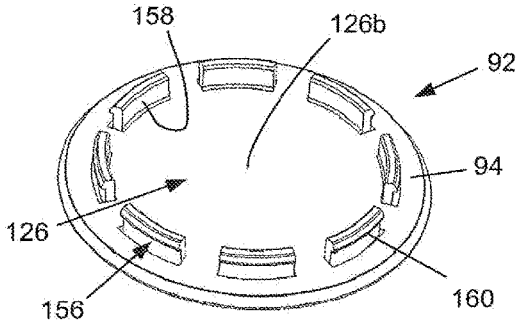
FIG. 43 is a top perspective view of the bottom cap of FIG. 41.
Figure 44:
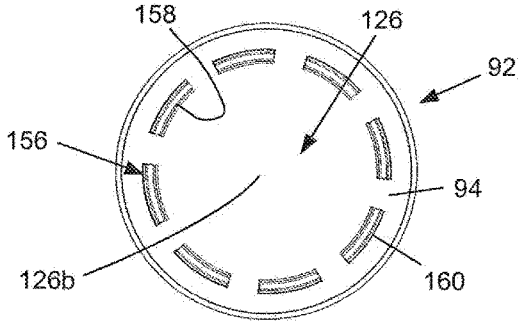
FIG. 44 is a top view of the bottom cap of FIG. 41.

The top cap 90 for the universal fitting 10 shown in the figures has a component section 126 that is configured as a grate 126*d* that is, from above at least, substantially the same as the grate 30 for the channel drain 12 having an upper surface 46 with a plurality of openings 48, as best shown in FIGS. 11-13, 16, 18, 35-41 and 45-47. As with the grate 30 for channel drain 12, the gate 126*d* of the top cap 90 is structured and arranged for water and/or other liquids 23 to flow from the top surface 44 of the surrounding media 44 downward through the top cap 90 into the interior area 108 of the drain fitting 10 so the liquid will flow through the channel drain 12 along flow path 28 which is defined by the U-shaped channel 26 of the channel drain 12. With regard to the top cap 90 the grate 126*d* is integrally formed with plate section 124, which generally surrounds the grate 126*d*, as best shown in FIGS. 35 and 40. As set forth in more detail below, the top cap 90 has a base mounting assembly 162, which is best shown in FIGS. 35 and 39-40, that is structured and arranged to engage the leg assembly 98 of the base 80 and the top edges 132 of the plate sections 124 of the end caps 82/84 and side caps 86/88 in a manner which secures the top cap 90 in place and presses downward on the end caps 82/84 and side caps 86/88 to hold the universal fitting 10 together as a single component. As with the end caps 82/84, side caps 86/88 and bottom cap 90 described above, persons who are skilled in the relevant art will readily appreciate that the arrangement of the channel drain system 11 may prescribe a different type of component section 126 for the top cap 90.

In the embodiment shown in the figures, the base mounting assembly 162 of the top cap 90 comprises a support frame 164 and a peripherally disposed plate lip 166, as best shown in FIGS. 39-40, that function together to engage the top edges 132 of the plate sections 124 of the end caps 82/84 and side caps 86/88. The support frame 164 comprises a plurality of frame members 168 that provide structural support for the top cap 90. The outside edge of the support frame 164 has side members 170 and corner members 172. The side members 170 structured and arranged to abut the inwardly facing surfaces 148 of the plate sections 124 at or near the top edge 132 thereof and the corner members 172 are structured and arranged to engage the inner surface of the slot members 115 on the inside of the leg members 100 of leg assembly 98 when the top cap 90 is positioned on the base 80. The plate lip 166 of the base mounting assembly 162 is structured and arranged to engage the outwardly facing surfaces 146 of the plate sections 124 at or near the top edge 132 thereof when the top cap 90 is positioned on the base 80. In addition, each slot member 115 has a top post 174 at an upper end 115 thereof, as best shown in FIGS. 19-21 and 48, that is structured and arranged to be engagedly received a top post area 176 disposed between the corner members 172 and the plate lip 166 at each corner of the top cap 90, as best shown in FIGS. 39-40. When the top cap 90 is placed onto the base 80, the top post area 176 will engage the top post 174 and the top edges 132 of the plate sections 124 of each of the end caps 82/84 and side caps 86/88 will be received in a plate edge area 178 between the plate lip 166 and each of the side members 170 and corner members 172 to secure the top cap 90 to base 80 and end caps 82/84 and side caps 86/88 and to hold these components of the universal fitting 10 together as a single unit.

Figure 45:
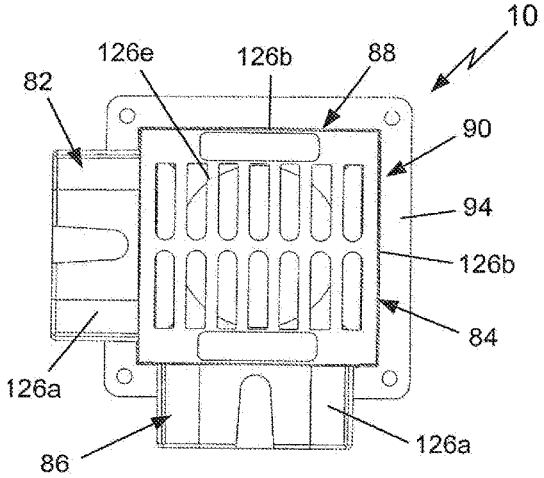
FIG. 45 is a top view of a third embodiment of the universal channel drain fitting of the present invention with the fitting configured as an elbow fitting having couplers at each of the rearward end and right side of the fitting.
Figure 46:
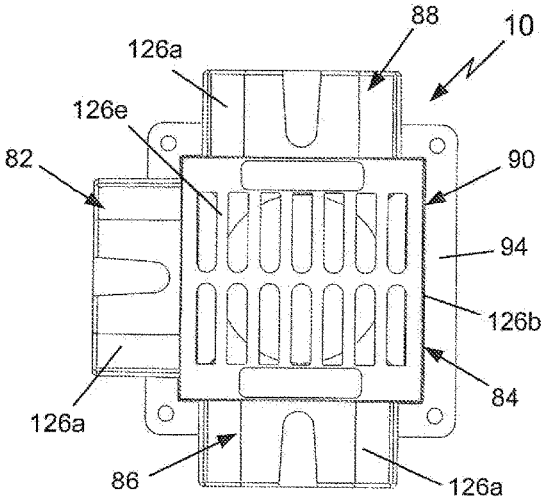
FIG. 46 is a top view of a fourth embodiment of the universal channel drain fitting of the present invention with the fitting configured as a tee fitting having couplers at each of the first/rearward end, first/right side and second/left side of the fitting.
Figure 47:
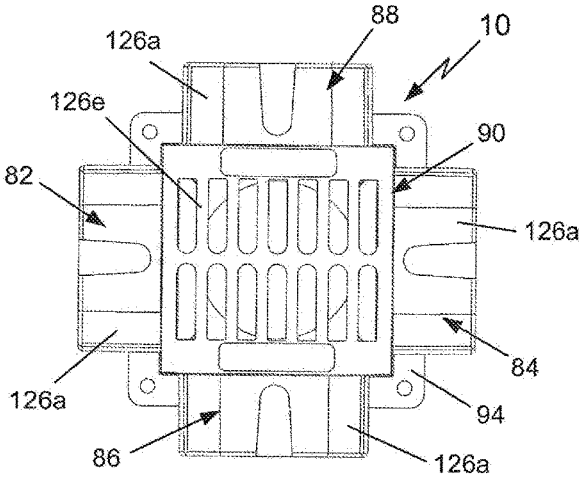
FIG. 47 is a top view of a fifth embodiment of the universal channel drain fitting of the present invention with the fitting configured as a cross fitting having couplers at each of the first/rearward end, second/forward end, first/right side and second/left side of the fitting.

Additional alternative configurations for the universal fitting 10 of the present invention are shown in FIGS. 45-47. Each of the universal fittings 10 have a first/rearward end cap 82 has a component section 126 that is configured as a coupler 126*a* to connect to a rearwardly positioned channel drain 12 and are shown without a bottom cap 92. In FIG. 45, the first/right side cap 86 has a component section 126 that is a coupler 126*a* and the second/forward end cap 84 has a component section 126 that is a solid plate 126*b* to form an elbow type fitting that connects to a channel drain 12 to direct water or other liquids 23 flowing in flow path 28 in a rightward direction. In FIG. 46, the first/right side cap 86 has a component section 126 that is a coupler 126*a*, the second/left side cap 88 also has a component section 126 that is a coupler 126*a* and the second/forward end cap 84 has a component section 126 that is a solid plate 126*b* to form a tee type fitting that connects to a channel drain 12 to direct water or other liquids 23 flowing in flow path 28 in both a rightward and a leftward direction. In FIG. 47, the first/right side cap 86 has a component section 126 that is a coupler 126*a*, the second/left side cap 88 also has a component section 126 that is a coupler 126*a* and the second/forward end cap 84 has a component section 126 that is also a coupler 126*b* to form a cross type fitting that connects to a channel drain 12 to direct water or other liquids 23 flowing in flow path 28 in each of a forward, rightward and a leftward direction. The component sections 126 that are configured as a coupler 126*a* and solid plate 126*b* in FIGS. 45-47 are structured and arranged as set forth above to accomplish the channel drain system 11 purposes of controlling the flow of water or other fluid 23 by, respectively, connecting to a second/adjacent channel drain 12 or to another system part 13 of the channel drain system 11 or to stop the flow of water or other liquids 23 in the direction of the location of the solid plate 12*b*, such as stopping forward, rightward and/or leftward flow.

Figure 49:
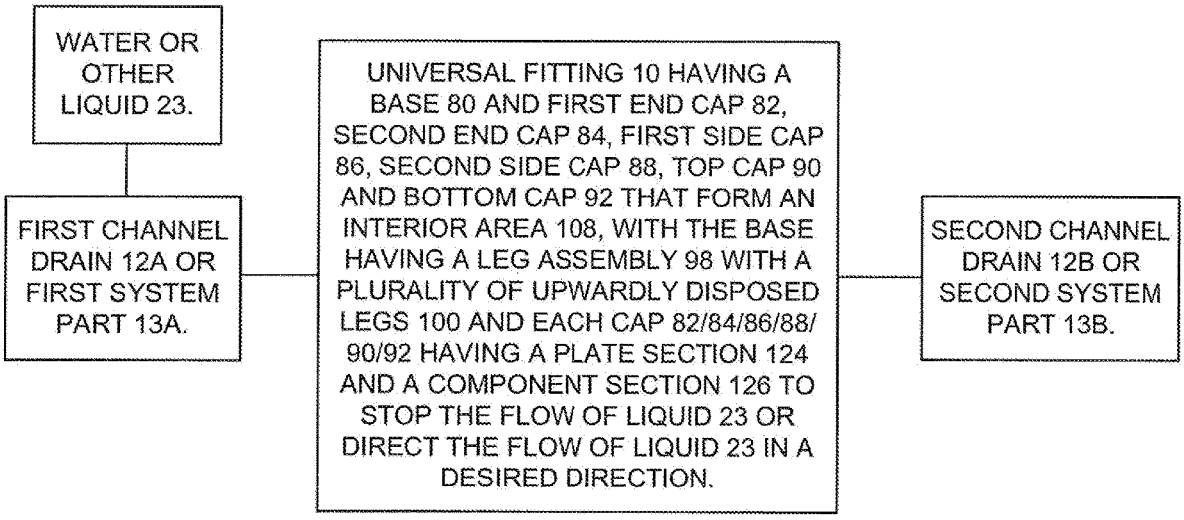
FIG. 49 is a chart showing a channel drain system that is configured according to a first embodiment of the present invention.

A channel drain system 11 which utilizes the new universal fitting 10 of the present invention, channel drains 12 and/or one or more system parts 13, such as pipes, other drains and the like, is summarized in FIG. 49. The first leg member pair 106*a*, which supports first/rearward end cap 82, defines a first end 182 of the universal fitting 10, the third leg member pair 106*c*, which supports second/forward end cap 84, defines a second end 184 of the universal fitting 10, the fourth leg member pair 106*d*, which supports the first/right side cap 86, defines a first side 186 of the universal fitting 10 and the second leg member pair 106*b*, which supports the second/left side cap 88, defines a second side 88, as best shown in FIGS. 16 and 48. One of a first channel drain 12 or a first drain part 13*a* connects to the rearwardly extending coupler 126*a* of the first/rearward end cap 82 at the first side of the universal fitting 10. One or more of a second channel drain 12*b* and a second drain part 13*b* connects to one or more (whether forward, rightward or leftward) of second/forward end cap 84, first/right side cap 86 and second/left side cap 88 at, respectively, the third side 186, fourth side 188 and second side 184 of the universal fitting 10 of the present invention.

As will be readily appreciated by persons who are skilled in the relevant art, the configurations of the above-described end caps 82/84, side caps 86/88, top cap 90 and bottom cap 92 can be easily and quickly modified for any configuration of component section 126 that is required or desired by the installer of a channel drain system. In general, any type of component that is utilized or desired to be utilized in a channel drain system 11 can be incorporated into any one or more of the end caps 82/84, side caps 86/88, top cap 90 and bottom cap 92. As such, the universal fitting 10 is not limited to any particular configuration or size of fitting. Specifically, the universal fitting 10 is not limited to the types of component sections 22 or 126 that are described above and/or shown in the figures. A person who is skilled in the relevant art that virtually any type of component 22/126 can be attached to or integrally formed with a plate section 124 and used for any of the end caps 82/84, side caps 86/88, top cap 90 and bottom cap 92 of the universal fitting 10.

The new universal fitting 10 provides a single fitting that can be easily and quickly configured to achieve any of the desired functions for a channel drain system 11. In the preferred embodiments, the new universal fitting can be assembled very simply and quickly without the use of any tools, adhesives, welding or the like. Because of this, the installer just has to have a universal fitting kit, comprising the base 80 and a variety of different types of end caps 82/84, side caps 86/88, top cap 90 and bottom cap 92, available to him or her. Having a universal fitting kit eliminates the need to have a multitude of prior art fittings 14 available to him or her to install a channel drain system 11.

The new universal fitting 10 also makes it much easier to modify an existing channel drain system 11 to add or modify or to branch off of a universal fitting 10 by allowing the user to just remove an existing plate section 124 and component section 126 combination of one or more of the end caps 82/84 and side caps 86/88 and replace it with a new end cap 82/84 and/or side cap 86/88 with, likely, a different plate section 124 and component section 126 combination in order to achieve a new configuration for the channel drain system 11.

In the preferred method of marketing the universal fitting 10, the components of this universal fitting 10 will be packed in a small kit box and have all the various end caps 82/84, side caps 86/88, top cap 90 and bottom cap 92 components to make any of the fittings that may be required to install a channel drain system 11. As will be readily understood by persons who are skilled in the relevant art, some of the fittings that can be assembled from such a kit include a coupler 126*a*, solid end plate 126*b*, a tee to join two perpendicular channel drains 12, an elbow to turn a ninety degree corner, a 4-way cross to connectedly join two perpendicular channel drains 12 and a forwardly disposed channel drain 12, a bottom drain 126*d*, with or without a leaf catcher, to connect to a discharge pipe from the bottom, and an end adapter 22*c* to connect to a discharge pipe and the like. In the preferred embodiments, the new universal fitting 10 is made from same materials as prior art channel drain fittings 14 and are at least strong enough for a person to stand on and for lawn equipment and the like to pass over.

While there are shown and described herein various specific forms of the present invention, it will be readily apparent to those persons who are skilled in the relevant art that the invention is not so limited, but is susceptible to various modifications and rearrangements in design and materials without departing from the spirit and scope of the invention. In particular, it should be noted that the present invention is subject to modification with regard to any dimensional relationships that may be set forth herein and to modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventor(s) and to enable other persons who are skilled in the relevant art to make and utilize the present invention without any undue experimentation. Although, the described embodiments may comprise one or more different features, not all of these features are required in all embodiments of the present invention. More specifically, as will be readily appreciated by persons who are skilled in the relevant art, certain embodiments of the present invention only utilize some of the features and/or combinations of features disclosed herein.

What is claimed is:

1. A universal channel drain fitting, comprising:

a base having a base panel and a leg assembly, said base panel having an upper surface and a lower surface, said leg assembly attached to or integral with said base panel so as to extend upwardly from said upper surface thereof, said leg assembly having a plurality of upwardly extending leg members that are structured and arranged for each of said plurality of leg members to have at least two adjacent leg members so as to form a plurality of leg member pairs;

one or more end caps, each one of said one or more end caps having a plate section and a component section, said plate section of each of said one or more end caps being cooperatively structured and arranged with said leg assembly so as to be upwardly supported by one of said plurality of leg member pairs;

one or more side caps, each one of said one or more side caps having a plate section and a component section, said plate section of each of said one or more side caps being cooperatively structured and arranged with said leg assembly so as to be upwardly supported by one of said plurality of leg member pairs;

a bottom cap having a base panel and component section, said bottom cap structured and arranged to be positioned against at least one of said upper surface and said lower surface of said base panel; and a top cap having a plate section and a component section, said top cap structured and arranged to be positioned in spaced apart relation above said base panel and engage at least one of said leg assembly, said one or more end caps and said one or more side caps, wherein said base, said one or more end caps, said one or more side caps, said bottom cap and said top cap define an interior area of said universal channel drain fitting that will receive a liquid into said interior area thereof from a flow path through a channel drain so as to control the continued flow of the liquid.

2. The universal channel drain fitting of claim 1, wherein said each of said leg members have a slot associated therewith and each of said plate sections of said end caps and said side caps are cooperatively sized and arranged for said plate sections to slidably engage said slots of said leg members so as to upwardly support said end caps and said side caps on said base.

3. The universal channel drain fitting of claim 2, wherein said top member has a downwardly extending base mounting assembly attached to or integral with said plate section of said top member, said base mounting assembly having a plurality of side members and lip members defining a plate edge area therebetween, said plate edge area sized and configured to receivably engage a top edge of each of said plate sections therein to hold each of said one or more end caps and said one or more side caps in place on said base.

4. The universal channel drain fitting of claim 3, wherein said base mounting assembly comprises a corner member interconnecting each of said side members and a top post area defined between each of said corner members and said plate lip, each of said top post areas sized and configured to engagedly receive a top post of said leg assembly so as to secure said top cap to said base.

5. The universal channel drain fitting of claim 1, wherein said leg assembly further comprises a leg base interconnecting each of said leg members, said leg base having an upwardly extending slot member at each of said leg members, each of said leg members having a slot associated therewith that is sized and configured to slidably receive one of said plate sections of said end caps and said side caps, said leg base having a slot therein that is sized and configured to receive a bottom edge of said plate sections of each of said end caps and each of said side caps.

6. The universal channel drain fitting of claim 5, wherein said slot member defines said slot associated with each of said leg members, each of said slots of said leg members being sized and configured to slidably receive one of a first edge and a second edge of each of said plate sections of said end caps and said side caps.

7. The universal channel drain fitting of claim 6, wherein each of said slots associated with said leg members are connected to said slot of said leg base between each of said leg member pairs to define a slot group that receives one of said plate sections of said one or more end caps and said one or more side caps therein.

8. The universal channel drain fitting of claim 1, wherein said one or more end caps comprises a first end cap and a second end cap, said one or more side caps comprises a first side cap and a second side cap, said leg assembly comprises a first leg member, a second leg member, a third leg member and a fourth leg member, said first leg member and said second leg member defining a first leg member pair for supporting said first end cap, said second leg member and said third leg defining a second leg member pair for supporting said second side cap, said third leg member and said fourth leg member defining a third leg member pair for supporting said second end cap and said fourth leg member and said first leg member defining a fourth leg member pair for supporting said first side cap.

9. The universal channel drain fitting of claim 8, wherein said component section of said first end cap is a coupler and said component section of said top cap is a grate.

10. The universal channel drain fitting of claim 1, wherein said base panel has a panel opening disposed therethrough and said bottom cap has an opening engaging mechanism structured and arranged to engage said panel opening of said base panel of said base so as to secure said bottom cap to said base of said universal channel drain fitting.

11. The universal channel drain fitting of claim 10, wherein said opening engaging mechanism comprises a plurality of clip members that are each structured and arranged to be received in and engage said panel opening.

12. The universal channel drain fitting of claim 1, wherein said component section of said one or more end caps and said one or more side caps is one of a coupler, a solid plate and an adapter, said component section of said top plate is a grate and said component section of said bottom cap is one of a coupler, a solid plate and a bottom drain.

13. A universal channel drain fitting, comprising:

a base having a base panel and a leg assembly, said base panel having an upper surface and a lower surface, said leg assembly attached to or integral with said base panel so as to extend upwardly from said upper surface thereof, said base panel having a panel opening disposed therethrough, said leg assembly having a plurality of upwardly extending leg members disposed generally around said panel opening so as to define a first end, a second end, a first side and a second side of said universal channel drain fitting, said plurality of leg members comprising a first leg member, a second leg member, a third leg member and a fourth leg member, each of said leg members having a slot associated therewith, said leg members being structured and arranged for each of said plurality of leg members to have at least two adjacent leg members so as to form a plurality of leg member pairs;

a plurality of end caps comprising a first end cap associated with said first end of said universal channel drain fitting and a second end cap associated with said second end of said universal drain fitting;

a plurality of side caps comprising a first side cap associated with said first side of said universal channel drain fitting and a second side cap associated with said second side of said universal channel drain fitting, each of said plurality of end caps and said plurality of side caps having a plate section and a component section, said plate section of each of said plurality of end caps and said plurality of side caps being cooperatively structured and arranged with said slots of said leg assembly so as to slidably engage said slots to upwardly support said plurality of end caps and said plurality of side caps in said slots between one of said plurality of leg member pairs;

a bottom cap having a base panel and component section, said bottom cap having an opening engaging mechanism structured and arranged to engage said panel opening of said base panel so as to secure said bottom cap to said base panel; and a top cap having a plate section, a component section attached to or integral with said plate section and a downwardly base mounting assembly attached to or integral with said plate section, said base mounting assembly structured and arranged to position said top cap in spaced apart relation above said base panel by engaging at least one of said leg assembly, said plurality of end caps and said plurality of side caps, wherein said base, said plurality of end caps, said plurality of side caps, said bottom cap and said top cap define an interior area of said universal channel drain fitting that will receive a liquid into said interior area thereof from a flow path through a channel drain so as to control the continued flow of the liquid.

14. The universal channel drain fitting of claim 13, wherein said base mounting assembly has a plurality of side members and lip members defining a plate edge area therebetween, said plate edge area sized and configured to receivably engage a top edge of each of said plate sections therein to hold each of said one or more end caps and said one or more side caps in place on said base.

15. The universal channel drain fitting of claim 14, wherein said base mounting assembly comprises a corner member interconnecting each of said side members and a top post area defined between each of said corner members and said plate lip, each of said top post areas sized and configured to engagedly receive a top post of said leg assembly so as to secure said top cap to said base.

16. The universal channel drain fitting of claim 13, wherein said leg assembly further comprises a leg base interconnecting each of said leg members, said leg base having an upwardly extending slot member at each of said leg members so as to define said slot associated with each of said leg members, said leg base having a slot therein sized and configured to receive a bottom edge of said plate sections of each of said plurality of end caps and each of said plurality of side caps.

17. The universal channel drain fitting of claim 13, wherein said opening engaging mechanism comprises a plurality of clip members that are each structured and arranged to be received in and engage said panel opening.

18. The universal channel drain fitting of claim 13, wherein said component section of said one or more end caps and said one or more side caps is one of a coupler, a solid plate and an adapter, said component section of said top plate is a grate and said component section of said bottom cap is one of a coupler, a solid plate and a bottom drain.

19. A universal channel drain fitting, comprising:

a base having a base panel and a leg assembly, said base panel having an upper surface and a lower surface, said leg assembly attached to or integral with said base panel so as to extend upwardly from said upper surface thereof, said base panel having a panel opening disposed therethrough, said leg assembly having a plurality of upwardly extending leg members positioned generally around said panel opening and a leg base interconnecting a plurality of upwardly extending slot members, said plurality of leg members comprising a first leg member, a second leg member, a third leg member and a fourth leg member that are configured to define a first end, a second end, a first side and a second side of said universal channel drain fitting, said plurality of leg members structured and arranged for each of said plurality of leg members to have at least two adjacent leg members so as to define a plurality of leg member pairs with said leg, one of said plurality of slot members associated with one of said plurality of leg members to define a slot associated with each of said plurality of leg members that is interconnected with a slot in said leg base to define a leg group associated with each one of said plurality of leg member pairs;

a plurality of end caps comprising a first end cap associated with said first end of said universal channel drain fitting and a second end cap associated with said second end of said universal drain fitting;

a plurality of side caps comprising a first side cap associated with said first side of said universal channel drain fitting and a second side cap associated with said second side of said universal channel drain fitting, each of said plurality of end caps and said plurality of side caps having a plate section and a component section, said plate section of each of said plurality of end caps and said plurality of side caps being cooperatively structured and arranged with said slot groups of said leg assembly to slidably engage one of said slot groups to upwardly support said plurality of end caps and said plurality of side caps in said one of said slot groups between said one of said plurality of leg member pairs;

a bottom cap having a base panel, a component section attached to or integral with an upper surface of said base panel and an opening engaging mechanism attached to or integral with said base panel, said opening engaging mechanism having a plurality of upwardly extending clip members structured and arranged to engage said panel opening to position said bottom cap below said lower surface of said base panel; and a top cap having a plate section, a component section attached to or integral with said plate section and a downwardly disposed base mounting assembly attached to or integral with said plate section, said base mounting assembly structured and arranged to position said top cap in spaced apart relation above said base panel by engaging said leg assembly, said plurality of end caps and said plurality of side caps, wherein said base, said plurality of end caps, said plurality of side caps, said bottom cap and said top cap define an interior area of said universal channel drain fitting that will receive a liquid into said interior area thereof from a flow path through a channel drain so as to control the continued flow of the liquid.

20. The universal channel drain fitting of claim 19, wherein said base mounting assembly of said top member has a plurality of side members, a corner member interconnecting each of said plurality of side members and a plate lip disposed around said side members and said corner members to define a plate edge area between said plurality of side members and said plate lip and a top post area between each of said corner members and said plate lip, said plate edge area being sized and configured to receivably engage a top edge of each of said plate sections to hold each of said plurality of end caps and said plurality of side caps in place on said base, each of said top post areas sized and configured to engagedly receive a top post of said leg assembly to secure said top cap to said base.

* * * * *